US011209740B2

(12) United States Patent
Hoshizaki et al.

(10) Patent No.: US 11,209,740 B2
(45) Date of Patent: Dec. 28, 2021

(54) ELECTROPHOTOGRAPHIC PHOTORECEPTOR, PROCESS CARTRIDGE, AND IMAGE FORMING APPARATUS

(71) Applicant: FUJIFILM Business Innovation Corp., Tokyo (JP)

(72) Inventors: Taketoshi Hoshizaki, Ebina (JP); Yusuke Watanabe, Ebina (JP); Keiko Matsuki, Ebina (JP); Yukiko Kamijo, Ebina (JP); Kenta Shingu, Ebina (JP); Tomoko Suzuki, Ebina (JP); Wataru Yamada, Ebina (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/984,821

(22) Filed: Aug. 4, 2020

(65) Prior Publication Data

US 2021/0311404 A1 Oct. 7, 2021

(30) Foreign Application Priority Data

Mar. 25, 2020 (JP) ..... JP2020-055090
Mar. 25, 2020 (JP) ..... JP2020-055092

(51) Int. Cl.
*G03G 5/00* (2006.01)
*G03G 5/05* (2006.01)
(Continued)

(52) U.S. Cl.
CPC ..... *G03G 5/05* (2013.01); *G03G 5/147* (2013.01); *G03G 5/14726* (2013.01); *G03G 15/0115* (2013.01)

(58) Field of Classification Search
CPC ..... G03G 5/14726
See application file for complete search history.

(56) References Cited

U.S. PATENT DOCUMENTS 9,507,282 B2 * 11/2016 Kihara ..... G03G 5/14726
2010/0248100 A1 * 9/2010 Ezumi ..... G03G 5/14726 430/56

(Continued)

FOREIGN PATENT DOCUMENTS

JP 06230590 A 8/1994
JP 2005099438 A 4/2005

(Continued)

OTHER PUBLICATIONS

English language machine translation of JP 2013-148792 (Aug. 2013).*

*Primary Examiner* — Mark A Chapman
(74) *Attorney, Agent, or Firm* — Sughrue Mion, PLLC

(57) ABSTRACT

An electrophotographic photoreceptor includes: a conductive base body and a photosensitive layer, in which an outermost surface layer of the electrophotographic photoreceptor contains fluorine-containing resin particles, and in which a fluorine atom concentration at a surface of the outermost surface layer is 1.5 to 5.0 times a fluorine atom concentration at a depth of 1 μm from the surface of the outermost surface layer, or in which a number density ratio of aggregates of the fluorine-containing resin particles in a second region defined in this specification, to aggregates of he fluorine-containing resin particles in a first region defined in this specification is less than 0.95, and a ratio of an area ratio of the fluorine-containing resin particles in the second region, to an area ratio of the flourine-containing resin particles in the first region is within a range of 1±0.1.

20 Claims, 4 Drawing Sheets

(51) Int. Cl.
*G03G 15/01* (2006.01)
*G03G 5/147* (2006.01)

(56) References Cited

U.S. PATENT DOCUMENTS

| | | | | |
|---|---|---|---|---|
| 2014/0072906 | A1* | 3/2014 | Iwadate | G03G 5/14795 430/56 |
| 2020/0257212 | A1* | 8/2020 | Iwasaki | G03G 5/14791 |

FOREIGN PATENT DOCUMENTS

| | | | | |
|---|---|---|---|---|
| JP | 2005266036 | A | | 9/2005 |
| JP | 2011022425 | A | | 2/2011 |
| JP | 2011090214 | A | | 5/2011 |
| JP | 2013148792 | A | * | 8/2013 |
| JP | 2015230406 | A | | 12/2015 |

* cited by examiner

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application Nos. 2020-055090 and 2020-055092 which were filed on Mar. 25, 2020.

BACKGROUND

1. Technical Field

The invention relates to an electrophotographic photoreceptor, a process cartridge, and an image forming apparatus.

2. Related Art

JP-A-2005-266036 discloses "a photoreceptor in which fluorine resin fine particles are contained in an outermost layer of the photoreceptor, the amount of fluorine atoms in the outermost surface of the photoreceptor increases and is saturated due to repeated use in an electrophotographic apparatus, and the saturation amount of the fluorine atoms in the outermost surface is 20 to 60 atm %".

JP-A-2011-090214 discloses "an electrode paste composition containing metal particles that contains copper as a main component, flux, glass particles, a solvent, and a resin".

SUMMARY

Aspects of non-limiting embodiments of the present disclosure relate to an electrophotographic photoreceptor which includes a conductive base body and a photosensitive layer, in which an outermost surface layer of the electrophotographic photoreceptor contains fluorine-containing resin particles. The electrophotographic photoreceptor suppresses occurrence of image defects in comparison to a case where a fluorine atom concentration at a surface of the outermost surface layer is less than 1.5 times or greater than 5.0 times a fluorine atom concentration at a depth of 1 μm from the surface of the outermost surface layer, or where a ratio (N2/N1) between a number density (N1) of aggregates of the fluorine-containing resin particles in a first region from a surface of the outermost surface layer to the half of the layer thickness of the outermost surface layer, and a number density (N2) of aggregates of the fluorine-containing resin particles in a second region from the half of the layer thickness of the outermost surface to the bottom face of the outermost surface layer is 0.95 or greater when a ratio (S2/S1) between an area ratio (S1) of the fluorine-containing resin particles in the first region and an area ratio (S2) of the fluorine-containing resin particles in the second region is within a range of 1±0.1.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an electrophotographic photoreceptor including a conductive base body and a photosensitive layer, in which an outermost surface layer of the electrophotographic photoreceptor contains fluorine-containing resin particles, and in which a fluorine atom concentration at a surface of the outermost surface layer is 1.5 to 5.0 times higher than a fluorine atom concentration at a depth of 1 μm from the surface of the outermost surface layer, or in which an outermost surface layer of the electrophotographic photoreceptor contains fluorine-containing resin particles, a ratio (N2/N1) between a number density (N1) of aggregates of the fluorine-containing resin particles in a first region from a surface of the outermost surface layer to a half of a layer thickness of the outermost surface layer and a number density (N2) of aggregates of the fluorine-containing resin particles in a second region from the half of the layer thickness of the outermost surface layer to a bottom face of the outermost surface layer is less than 0.95, and a ratio (S2/S1) between an area ratio (S1) of the fluorine-containing resin particles in the first region, and an area ratio (S2) of the fluorine-containing resin particles in the second region is within a range of 1±0.1.

BRIEF DESCRIPTION OF DRAWINGS

Exemplary embodiments of the present invention will be described in detail based on the following figures, wherein.

DETAILED DESCRIPTION

Figure 1:
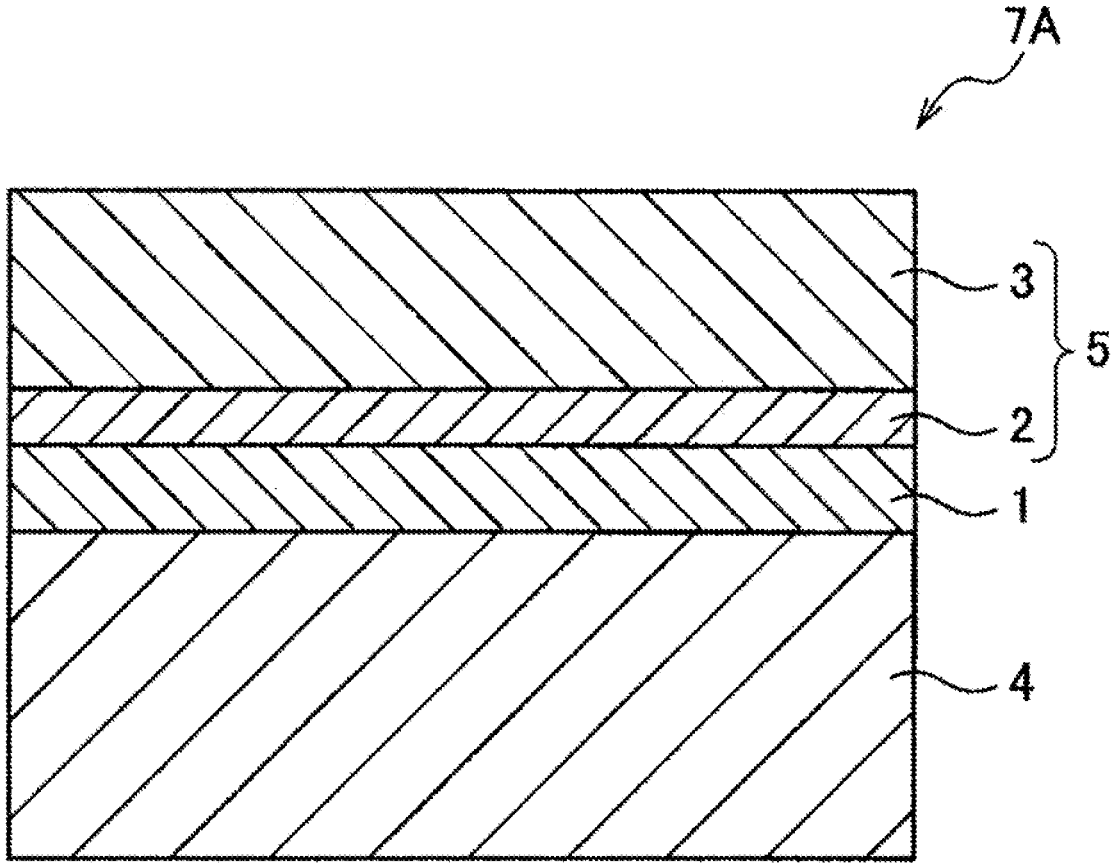
FIG. 1 is a schematic cross-sectional view illustrating an example of a layer configuration of an electrophotographic photoreceptor according to a first exemplary embodiment.

Hereinafter, description will be given of exemplary embodiments as examples of the invention. Description and examples thereof are illustrative of the exemplary embodiments, and do not limit the scope of the invention.

In numerical value ranges described stepwise in this specification, an upper limit value or a lower limit value described in one numerical value range may be substituted with an upper limit value or a lower limit value in a numerical value range of another stepwise description. In addition, in the numerical value ranges described in this specification, the upper limit value and the lower limit value of the numerical value ranges may be substituted with values described in examples.

Each component may include plural kinds of materials corresponding to the component.

When the amount of each component in a composition is stated, in a case where plural kinds of materials corresponding to the component exist in the composition, the amount represents a total amount of the plural kinds of materials existing in the composition unless otherwise stated.

First Example

<Electrophotographic Photoreceptor>

An electrophotographic photoreceptor according to this exemplary embodiment (hereinafter, also referred to as "photoreceptor") includes a conductive base body, and a photosensitive layer provided on the conductive base body, and an outermost surface layer contains fluorine-containing resin particles.

In addition, a fluorine atom concentration measured on a surface of the outermost surface layer is 1.5 to 5.0 times higher than a fluorine atom concentration measured in a depth of 1 μm from the surface of the outermost surface layer.

The photoreceptor according to this exemplary embodiment has the above-described configuration, and thus occurrence of streak-shaped image defects and a residual potential which are caused by rubbing between the photoreceptor and a member that comes into contact with the photoreceptor due to vibration may be suppressed. The reason for this is assumed as follows.

In a case where the photoreceptor that contains the fluorine-containing resin particles in the outermost surface layer is transported in a state of being assembled to a process cartridge or an image forming apparatus, rubbing occurs between the photoreceptor and a member (a cleaning member and the like) that comes into contact with the photoreceptor due to vibration in transportation, and a rubbed portion of the photoreceptor may be frictionally charged to a positive polarity. In addition, in a state in which a portion frictionally charged to a positive polarity exists on the surface of the photoreceptor, when the photoreceptor is charged at the time of image formation, streak-shaped unevenness occurs in a surface potential of the photoreceptor, and according to this, the streak-shaped image defects occur. In addition, charges remain in the photosensitive layer of the photoreceptor, and a residual potential occurs.

On the other hand, in the photoreceptor that contains fluorine-containing resin particles in the outermost surface layer according to this exemplary embodiment, a fluorine atom concentration measured on a surface of the outermost surface layer is 1.5 to 5.0 times of a fluorine atom concentration measured at a depth of 1 μm from the surface of the outermost surface layer. That is, a lot of fluorine-containing resin particles are contained in the surface of the outermost surface layer. The fluorine-containing resin particles have a high negative polarity, and thus even in a case where rubbing occurs between the photoreceptor and the member that comes into contact with the photoreceptor occurs due to vibration in transportation, a positive charge that occurs due to friction is likely to be cancelled, and frictional charging of a rubbed portion of the photoreceptor to positive polarity may be suppressed. According to this, even when the photoreceptor is charged at the time of image formation, the streak-shaped unevenness is less likely to occur in a surface potential of the photoreceptor, and the residual potential may be also suppressed.

Accordingly, in the photoreceptor according to this exemplary embodiment, it is assumed that occurrence of the streak-shaped image defects and the residual potential which are caused by rubbing between the photoreceptor and a member that comes into contact with the photoreceptor due to vibration may be suppressed.

Hereinafter, the photoreceptor according to this exemplary embodiment will be described in detail.

Hereinafter, the electrophotographic photoreceptor according to this exemplary embodiment will be described with reference to the accompanying drawings.

As illustrated in FIG. 1, examples of the photoelectrographic photoreceptor includes a photoreceptor 7A having a structure in which an undercoat layer 1, a charge generation layer 2, and a charge transportation layer 3 are stacked in this order on a conductive base body 4. The charge generation layer 2 and the charge transportation layer 3 constitute a photosensitive layer 5.

Note that, the electrophotographic photoreceptor 7A may have a layer configuration in which the undercoat layer 1 is not provided.

In addition, the electrophotographic photoreceptor 7A may be a photoreceptor including a single-layer type photosensitive layer in which functions of the charge generation layer 2 and the charge transportation layer 3 are integrated. In the case of the photoreceptor including the single-layer type photosensitive layer, the single-layer photosensitive layer may constitute the outermost surface layer.

In addition, the electrophotographic photoreceptor 7A may be a photoreceptor including a surface protective layer on the charge transportation layer 3 or the single-layer type photosensitive layer. In the case of the photoreceptor including the surface protective layer, the surface protective layer constitutes the outermost surface layer.

Hereinafter, respective layers of the electrophotographic photoreceptor according to this exemplary embodiment will be described in detail. Note that, a reference numeral will be omitted in description.

(Conductive Base Body)

Examples of the conductive base body include a metal plate containing a metal (aluminum, copper, zinc, chromium, nickel, molybdenum, vanadium, indium, gold, platinum, or the like) or an alloy (stainless steel or the like), a metal drum, a metal belt, and the like. In addition, examples of the conductive base body also include paper, a resin film, a belt, and the like on which a conductive compound (for example, a conductive polymer, indium oxide, or the like), a metal (for example, aluminum, palladium, gold, or the like), or an alloy is applied, vapor-deposited, or laminated. Here, "conductive" represents that volume resistivity is less than $10^{13}$ Ωcm.

In a case where the electrophotographic photoreceptor is used in a laser printer, a surface of the conductive base body may be roughened in center line average roughness Ra of 0.04 to 0.5 μm for the purpose of suppressing interference fringe that occurs at the time of irradiation with laser light. Note that, in the case of using incoherence light as a light source, the roughening for preventing interference fringe is not particularly necessary. However, since occurrence of defects due to unevenness of the surface of the conductive base body is suppressed, the roughening is suitable for long operational lifetime.

Examples of a roughening method include wet honing that is carried out by suspending an abrasive in water and spraying the resultant solution to the conductive base body, centerless grinding in which the conductive base body is brought into pressure contact with a rotating grindstone and grinding is continuously performed, an anodic oxidation treatment, and the like.

Examples of the roughening method also include a method in which a conductive or semiconductive powder is dispersed in a resin, a layer is formed on a surface of the conductive base body, and roughening is performed with particles dispersed in the layer without roughening the surface of the conductive base body.

The roughening treatment by the anodic oxidation is to form an oxide film on the surface of the conductive base body by anodizing the conductive base body formed from a metal (for example, aluminum) as an anode in an electrolytic solution. Examples of the electrolytic solution include a sulfuric acid solution, an oxalic acid solution, and the like. However, a porous anodic oxide film formed by the anodic oxidation is chemically active as it is, is likely to be contaminated, and has a large resistance variation due to an environment. Here, a sealing treatment with respect to the porous anodic oxide film may be performed to convert the porous anodic oxide film into a more stable hydrous oxide by blocking fine holes of the oxide film with volume expansion by a hydration reaction in pressurized water vapor or boiling water (a metal salt of nickel or the like may be added).

For example, the film thickness of the anodic oxide film is preferably 0.3 to 15 μm. When the film thickness is within the range, a barrier property against injection tends to be exhibited, and an increase in a residual potential due to repeated use tends to be suppressed.

The conductive base body may be subjected to a treatment with an acidic treatment liquid or a boehmite treatment.

For example, the treatment with the acidic treatment liquid is performed as follows. First, an acidic treatment liquid containing phosphoric acid, chromic acid, hydrofluoric acid is prepared. With regard to a mixing ratio of the phosphoric acid, the chromic acid, and the hydrofluoric acid in the acidic treatment liquid, for example, the phosphoric acid may be in a range of 10% by mass to 11% by mass, the chromic acid may be in a range of 3% by mass to 5% by mass, and the hydrofluoric acid may be in a range of 0.5% by mass to 2% by mass, and a concentration of the entirety of the acids may be in a range of 13.5% by mass to 18% by mass. For example, a treatment temperature is preferably 42° C. to 48° C. The film thickness of the film is preferably 0.3 to 15 μm.

For example, the boehmite treatment is performed by immersing the conductive base body in pure water maintained at 90° C. to 100° C. for 5 to 60 minutes, or by bringing the conductive base body into contact with heated steam maintained at 90° C. to 120° C. for 5 to 60 minutes. The film thickness of the film is preferably 0.1 to 5 μm. The conductive base body may be subjected to anodic oxidation by using an electrolytic solution having low film solubility such as adipic acid, boric acid, borate, phosphate, phthalate, maleate, benzoate, tartrate, or citrate.

(Undercoat Layer)

For example, the undercoat layer is a layer containing inorganic particles and a binding resin.

Examples of the inorganic particles include inorganic particles having powder resistance (volume resistivity) of $10^2$ to $10^{11}$ Ωcm.

Among these, as inorganic particles having the above-described resistance value, for example metal oxide particles such as tin oxide particles, titanium oxide particles, zinc oxide particles, and zirconium oxide particles are preferable, and zinc oxide particles are more preferable.

For example, a specific surface area of the inorganic particles with a BET method may be 10 $m^2/g$ or greater.

For example, a volume-average particle size of the inorganic particles may be 50 to 2000 nm (preferably, 60 to 1000 nm).

For example, the amount of the inorganic particles contained is preferably 10% by mass to 80% by mass with respect to the binding resin, and more preferably 40% by mass to 80% by mass.

The inorganic particles may be subjected to a surface treatment. As the inorganic particles, two or more kinds of inorganic particles, which are subjected to surface treatments different from each other or have particle sizes different from each other, may be mixed and used.

Examples of a surface treatment agent include a silane coupling agent, a titanate-based coupling agent, an aluminum-based coupling agent, a surfactant, and the like. Particularly, the silane coupling agent is preferable, and a silane coupling agent having an amino group is more preferable.

Examples of the silane coupling agent having an amino group include 3-aminopropyltriethoxysilane, N-2-(aminoethyl)-3-aminopropyltrimethoxysilane, N-2-(amino ethyl)-3-aminopropylmethyldimethoxysilane, N,N-bis(2-hydroxyethyl)-3-aminopropyltriethoxysilane, and the like, but there is no limitation thereto.

The silane coupling agent may be used in a mixture of two or more kinds thereof. For example, the silane coupling agent having an amino group or another silane coupling agent may be used in combination. Examples of other silane coupling agents include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, 3-chloropropyltrimethoxysilane, and the like, but there is no limitation thereto.

The surface treatment method with the surface treatment agent may be any known method, and may be either a dry method or a wet method.

For example, a treatment amount of the surface treatment agent is preferably 0.5% by mass to 10% by mass with respect to the inorganic particles.

Here, the undercoat layer may contain an electron-accepting compound (an acceptor compound) in combination with the inorganic particles from the viewpoint that long-term stability of electrical characteristics, and carrier blocking properties increase.

Examples of the electron-accepting compound include electron transporting materials such as quinone-based compounds such as chloranil and bromoanil; tetracyanoquinodimethane-based compounds; fluorenone compounds such as 2,4,7-trinitrofluorenone and 2,4,5,7-tetranitro-9-fluorenone; oxadiazole-based compounds such as 2-(4-biphenyl)-5-(4-t-butylphenyl)-1,3,4-oxadiazole, 2,5-bis(4-naphthyl)-1,3,4-oxadiazole, and 2,5-bis(4-di ethyl aminophenyl)-1,3,4-oxadiazole; xanthone-based compounds; thiophene-based compounds; and diphenoquinone compounds such as 3,3',5,5'-tetra-t-butyldiphenoquinone; and the like.

Particularly, as the electron-accepting compound, a compound having an anthraquinone structure is preferable. As the compound having the anthraquinone structure, for example, a hydroxyanthraquinone compound, an aminoanthraquinone compound, an aminohydroxyanthraquinone compound, and the like are preferable, and specifically, for example, anthraquinone, alizarin, quinizarin, anthrarufin, purpurin, and the like are preferable.

The electron-accepting compound may be contained in the undercoat layer in a state of being dispersed in combination with inorganic particles, or may be contained in a state of being attached to a surface of the inorganic particles.

As a method of attaching the electron-accepting compound to the surface of the inorganic particles, a dry method or a wet method may be exemplified.

For example, the dry method is a method in which the electron-accepting compound is added dropwise directly or in a state of being dissolved in an organic solvent and is sprayed in combination with dry air or nitrogen gas while stirring inorganic particles with a mixer having a large shearing force to attach the electron-accepting compound to the surface of the inorganic particles. When adding the electron-accepting compound dropwise or spraying the electron-accepting compound, the treatment may be performed at a temperature equal to or lower than a boiling point of a solvent. After adding the electron-accepting compound dropwise or spaying the electron-accepting compound, baking may be further performed at a temperature of 100° C. or higher. Baking is not particularly limited as long as baking is set to a temperature and time at which electrophotographic characteristics are obtained.

For example, the wet method is a method in which the electron-accepting compound is added while dispersing inorganic particles in a solvent with stirring, ultrasonic waves, a sand mill, an attritor, a ball mill, or the like, the resultant mixture is stirred and dispersed, and the solvent is removed, thereby attaching the electron-accepting compound to the surface of the inorganic particles. With regard to a solvent removing method, the solvent is distilled by filtration or distillation. After removing the solvent, baking may be further performed at a temperature of 100° C. higher. Baking is not particularly limited as long as baking is set to a temperature and time at which electrophotographic characteristics are obtained. In the wet method, moisture contained in the inorganic particles may be removed before adding the electron-accepting compound, and examples thereof include a method of removing moisture while performing stirring and heating in a solvent, and a method of azeotropically removing moisture in combination with the solvent.

Note that, attachment of the electron-accepting compound may be performed before or after performing the surface treatment on the inorganic particles with the surface treatment agent, or the attachment of the electron-accepting compound and the surface treatment with the surface treatment agent may be performed simultaneously.

For example, the amount of the electron-accepting compound contained may be 0.01% by mass to 20% by mass with respect to the inorganic particles, and preferably 0.01% by mass to 10% by mass.

Examples of the binding resin used in the undercoat layer include known materials such as known polymer compounds such as an acetal resin (for example, polyvinyl butyral, and the like), a polyvinyl alcohol resin, a polyvinyl acetal resin, a casein resin, a polyamide resin, a cellulose resin, gelatin, a polyurethane resin, a polyester resin, an unsaturated polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, a urea resin, a phenol resin, a phenol-formaldehyde resin, a melamine resin, a urethane resin, an alkyd resin, and an epoxy resin; a zirconium chelate compound; a titanium chelate compound; an aluminum chelate compound; a titanium alkoxide compound; an organic titanium compound; and a silane coupling agent.

Examples of the binding resin that is used in the undercoat layer also include a charge transporting resin having a charge transporting group, a conductive resin (for example, polyaniline), and the like.

Among these, a resin that is insoluble in an upper layer application solvent is suitable as the binding resin that is used in the undercoat layer, and particularly, thermosetting resins such as such as the urea resin, the phenol resin, the phenol-formaldehyde resin, the melamine resin, the urethane resin, the unsaturated polyester resin, the alkyd resin, and the epoxy resin; and a resin obtained by a reaction between at least one kind of resin selected from the group consisting of the polyamide resin, the polyester resin, the polyether resin, the methacrylic resin, the acrylic resin, the polyvinyl alcohol resin, and the polyvinyl acetal resin, and a curing agent are suitable.

In the case of using the binding resins in combination of two or more kinds, a mixing ratio is set in correspondence with necessity.

The undercoat layer may include various additives for electrical characteristic improvement, environmental stability improvement, and image quality improvement.

Examples of the additive include known material such as electron transporting pigments of a polycyclic condensation type, an azo type, and the like, a zirconium chelate compound, a titanium chelate compound, an aluminum chelate compound, a titanium alkoxide compound, an organic titanium compound, and a silane coupling agent. The silane coupling agent is used for the surface treatment of the inorganic particles as described above, but may be further added to the undercoat layer as an additive.

Examples of the silane coupling agent as an additive include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, 3-chloropropyltrimethoxysilane, and the like.

Examples of zirconium chelate compound include zirconium butoxide, ethyl zirconium acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide, and the like.

Examples of the titanium chelate compound include tetraisopropyl titanate, tetranormal butyl titanate, butyl titanate dimer, tetra(2-ethylhexyl) titanate, titanium acetylacetonate, polytitanium acetylacetonate, titanium octylene glycolate, titanium lactate ammonium salt, titanium lactate, titanium lactate ethyl ester, titanium triethanolaminate, polyhydroxytitanium stearate, and the like.

Examples of the aluminum chelate compound include aluminum isopropylate, monobutoxyaluminum diisopropylate, aluminum butyrate, diethyl acetoacetate aluminum diisopropylate, aluminum tris(ethylacetoacetate), and the like.

The additives may be used alone or as a mixture or polycondensate of plural compounds.

The undercoat layer may have Vickers hardness of 35 or greater.

The surface roughness (10-point average roughness) of the undercoat layer may be adjusted to from 1/(4n) (n is a refractive index of an upper layer) to ½ of an exposure laser wavelength λ that is used for suppressing a moire image.

Resin particles or the like may be added in the undercoat layer to adjust the surface roughness. Examples of the resin particles include silicone resin particles, crosslinked polymethylmethacrylate resin particles, and the like. The surface of the undercoat layer may be polished to adjust the surface roughness. Examples of a polishing method include buff polishing, sandblasting, wet honing, grinding, and the like.

Formation of the undercoat layer is not particularly limited, and a known formation method is used. For example, the formation is performed as follows. A coated film of an undercoat layer forming application solution obtained by adding the above-described components to a solvent is formed, and the coated film is dried and is heated as necessary.

Examples of the solvent for preparing the undercoat layer forming application solution include a known organic solvent, for example, an alcohol solvent, an aromatic hydrocarbon solvent, a halogenated hydrocarbon solvent, a ketone-based solvent, a ketone-alcohol-based solvent, an ether-based solvent, an ester-based solvent, and the like.

Specific examples of the solvent include typical organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Examples of a method of dispersing the inorganic particles when preparing the undercoat layer forming application solution include known methods such as a roll mill, a ball mill, a vibrating ball mill, an attritor, a sand mill, a colloid mill, and a paint shaker.

Examples of a method of applying the undercoat layer forming application solution onto the conductive base body include typical methods such as a blade coating method, a wire bar coating method, a spray coating method, a dip coating method, a bead coating method, an air knife coating method, and a curtain coating method.

For example, the film thickness of the undercoat layer is preferably set to 15 μm or greater, and more preferably in a range of 20 to 50 μm.

(Intermediate Layer)

Although not illustrated in the drawing, an intermediate layer may be formed between the undercoat layer and the photosensitive layer.

For example, the intermediate layer is a layer containing a resin. Examples of the resin that is used in the intermediate layer include polymer compounds such as an acetal resin (for example, polyvinyl butyral or the like), a polyvinyl alcohol resin, a polyvinyl acetal resin, a casein resin, a polyamide resin, a cellulose resin, gelatin, a polyurethane resin, a polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, a phenol-formaldehyde resin, and a melamine resin.

The intermediate layer may be a layer containing an organic metal compound. Examples of the organic metal compound that is used in the intermediate layer include organic metal compounds containing metal atoms such as zirconium, titanium, aluminum, manganese, and silicon.

The compounds which are used in the intermediate layer may be used alone or as a mixture or a polycondensate of plural compounds.

Among these, it is preferable that the intermediate layer is a layer containing an organic metal compound containing zirconium atoms or silicon atoms.

Formation of the intermediate layer is not particularly limited, and known formation methods are used. For example, the formation is performed as follows. A coated film of an intermediate layer forming application solution obtained by adding the above-described components to a solvent is formed, and the coated film is dried as necessary.

As an application method for forming the intermediate layer, typical methods such as a dip coating method, a push-up coating method, a wire bar coating method, a spray coating method, a blade coating method, a knife coating method, and a curtain coating method are used.

For example, the film thickness of the intermediate layer is preferably set to a range of 0.1 to 3 μm. Note that, the intermediate layer may be used as the undercoat layer.

(Charge Generation Layer)

For example, a charge generation layer is a layer containing a charge generation material and a binding resin. In addition, the charge generation layer may be a vapor-deposited layer of the charge generation material. The vapor-deposited layer of the charge generation material is suitable for the case of using an incoherence light source such as a light emitting diode (LED), an organic electroluminescence (EL) image array.

Examples of the charge generation material include azo pigments such as bisazo and trisazo; condensed ring aromatic pigments such as dibromoanthanthrone; perylene pigments; pyrrolopyrrole pigments; phthalocyanine pigments; zinc oxide; and trigonal selenium.

Among these, it is preferable to use a metal phthalocyanine pigment or a metal-free phthalocyanine pigment as the charge generation material in order to cope with laser exposure in a near infrared region. Specifically, for example, hydroxygallium phthalocyanine disclosed in JP-A-5-263007, JP-A-5-279591, and the like; chlorogallium phthalocyanine disclosed in JP-A-5-98181 and the like; dichlorotin phthalocyanine disclosed in JP-A-5-140472, JP-A-5-140473, and the like; and titanyl phthalocyanine disclosed in JP-A-4-189873 are more preferable.

On the other hand, to cope with laser exposure a near ultraviolet region, as the charge generating material, condensed ring aromatic pigments such as dibromoanthanthrone; thioindigo-based pigments; porphyrazine compounds; zinc oxide; trigonal selenium; bisazo pigments disclosed in JP-A-2004-78147 and JP-A-2005-181992, and the like are preferable.

Even in the case of using an incoherence light source such as an LED and an organic EL image array in which a light-emission center wavelength is in 450 nm to 780 nm, the charge generation material may be used. However, from the viewpoint of resolution, when using the photosensitive layer in a thin film of 20 μm or less, electric field intensity in the photosensitive layer becomes high, and a decrease in charging due to charge injection from the base body, image defects called so-called black spot are likely to occur. This becomes remarkable when using a charge generation material such as trigonal selenium and phthalocyanine pigment which are p-type semiconductors and are likely to generate a dark current.

In contrast, in the case of using an n-type semiconductor such as a condensed aromatic pigment, a perylene pigment, or an azo pigment as the charge generation material, a dark current is less likely to occur, and even in a thin film, an image defect called a black spot may be suppressed. Examples of the n-type charge generation material include compounds (CG-1) to (CG-27) described in paragraphs [0288] to [0291] in JP-A-2012-155282, but there is no limitation thereto.

Note that, determination of the n-type is made by a polarity of a flowing photocurrent by using a time-of-flight method that is typically used, and a case where electrons are more likely to be caused to flow as a carrier in comparison to holes is set as the n-type.

The binding resin that is used in the charge generation layer is selected from various insulating resins, and the binding resin may be selected from organic photoconductive polymers such as poly-N-vinylcarbazole, polyvinylanthracene, polyvinylpyrene, and polysilane.

Examples of the binding resin include a polyvinyl butyral resin, a polyarylate resin (polycondensate of bisphenols and aromatic divalent carboxylic acid, or the like), a polycarbonate resin, a polyester resin, a phenoxy resin, a vinyl chloride-vinyl acetate copolymer, a polyamide resin, an acrylic resin, a polyacrylamide resin, a polyvinyl pyridine resin, a cellulose resin, a urethane resin, an epoxy resin, casein, a polyvinyl alcohol resin, a polyvinyl pyrrolidone resin, and the like. Here, "insulating" represents that volume resistivity is $10^{13}$ Ωcm or greater.

The binding resins are used alone or two or more kinds thereof are mixed and used.

Note that, a mixing ratio of the charge generation material and the binding resin is preferably in a range of 10:1 to 1:10 in terms of mass ratio.

The charge generation layer may include other known additives.

Formation of the charge generation layer is not particularly limited, and a known formation method is used. For example, the formation is performed as follows. A coated film of a charge generation layer forming application solution obtained by adding the above-described components to a solvent is formed, and the coated film is dried and is heated as necessary. Note that, formation of the charge generation layer may be performed vapor deposition of the charge generation material. Formation of the charge generation layer by vapor deposition is particularly suitable for the case of using the condensed aromatic pigment or the perylene pigment as the charge generation material.

Examples of the solvent for preparing the charge generation layer forming application solution include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, toluene, and the like. These solvents are used alone or two or more kinds thereof are mixed and used.

As a method of dispersing particles (for example, the charge generation material) in the charge generation layer forming application solution, for example, a media disperser such as a ball mill, a vibrating ball mill, an attritor, a sand mill, and a horizontal sand mill, or a medialess disperser such as an agitator, an ultrasonic disperser, a roll mill, and a high-pressure homogenizer is used. Examples of the high-pressure homogenizer include a collision method in which a dispersion solution is subjected to liquid-liquid collision or liquid-wall collision in a high pressure state to disperse, and a passing method in which the dispersion solution passes through a fine flow passage in a high pressure state to disperse, and the like.

Note that, at the time of the dispersion, it is effective for an average particle size of the charge generation material in the charge generation layer formation application solution to be set to 0.5 μm or less, preferably 0.3 μm or less, and more preferably 0.15 μm or less.

Examples of a method of applying the charge generation layer forming application solution onto the undercoat layer (or the intermediate layer) include typical methods such as a blade coating method, a wire bar coating method, a spray coating method, a dip coating method, a bead coating method, an air knife coating method, and a curtain coating method.

For example, the film thickness of the charge generation layer is preferably set in a range of 0.1 to 5.0 μm, and more preferably in a range of 0.2 to 2.0 μm.

(Charge Transportation Layer)

The charge transportation layer is a layer containing, for example, a charge transportation material and a binding resin. The charge transportation layer may be a layer containing a polymer charge transportation material.

In a case where the charge transportation layer is an outermost surface layer, the charge transportation layer contains fluorine-containing resin particles in addition to the binding resin and the charge transportation material.

Note that, in a case where another layer (for example, a surface protective layer or the like) is provided on the charge transportation layer, and the charge transportation layer is not the outermost surface layer, the charge transportation layer may contain at least the binding resin and the charge transportation material, and may contain other additives as necessary. The binding resin, the charge transportation material, and the other additives are similar to a case where the charge transportation layer is the outermost surface layer.

—Binding Resin—

Examples of the binding resin that is used in the charge transportation layer include a polycarbonate resin, a polyester resin, a polyarylate resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone alkyd resin, a phenol-formaldehyde resin, a styrene-alkyd resin, poly-N-vinylcarbazole, polysilane, and the like. Among these, the polycarbonate resin or the polyarylate resin is preferable as the binding resin. These binder resins are used alone or in combination of two or more kinds.

Note that, a mixing ratio between the charge transportation material and the binding resin is preferably 10:1 to 1:5 in terms of mass ratio.

Here, for example, the amount of the binding resin contained is preferably 10% by mass to 90% by mass with respect to a total solid content of the photosensitive layer (charge transportation layer), more preferably 30% by mass to 80% by mass, and still more preferably 40% by mass to 70% by mass.

—Charge Transportation Material—

Examples of the charge transportation material include electron transporting compounds such as quinone compounds such as p-benzoquinone, chloranil, bromanyl, and anthraquinone; tetracyanoquinodimethane-based compounds; fluorenone compounds such as 2,4,7-trinitrofluorenone; xanthone-based compounds; benzophenone-based compounds; cyanovinyl-based compounds; and ethylene-based compounds. Examples of the charge transportation material also include hole transporting compounds such as triarylamine-based compounds, benzidine-based compounds, arylalkane-based compounds, aryl-substituted ethylene-based compounds, stilbene-based compounds, anthracene-based compounds, and hydrazine-based compounds. The charge transportation materials may be used alone or in combination of two or more kinds, but there is no limitation thereto.

As the charge transportation material, from the viewpoint of charge mobility, a triarylamine derivative expressed by the following General Formula (a-1) and a benzidine derivative expressed by the following General Formula (a-2) are preferable.

(a-1)

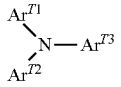

In General Formula (a-1), $Ar^{T1}$, $Ar^{T2}$, and $Ar^{T3}$ each independently represent a substituted or unsubstituted aryl group, $—C_6H_4—C(R^{T4})═C(R^{T5})(R^{T6})$, or $—C_6H_4—CH═CH—CH═C(R^{T7})(R^{T8})$. $R^{T4}$, $R^{T5}$, $R^{T6}$, $R^{T7}$, and $R^{T8}$ each independently represent a hydrogen atom, a substituted or unsubstituted alkyl group, or a substituted or unsubstituted aryl group.

Examples of a substituent of each of the groups include a halogen atom, an alkyl group having 1 to 5 carbon atoms, and an alkoxy group having 1 to 5 carbon atoms. In addition, examples of the substituent of each of the groups also include a substituted amino group substituted with an alkyl group having 1 to 3 carbon atoms.

(a-2)

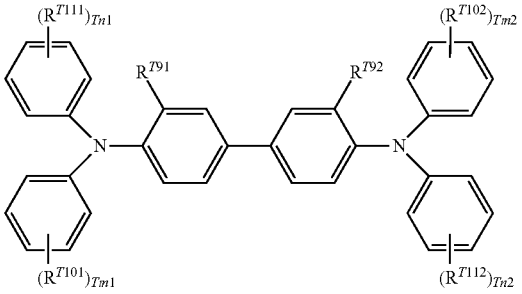

In General Formula (a-2), $R^{T91}$ and $R^{T92}$ each independently represent a hydrogen atom, a halogen atom, an alkyl group having 1 to 5 carbon atoms, or an alkoxy group having 1 to 5 carbon atoms. $R^{T101}$, $R^{T102}$, $R^{T111}$ and $R^{T112}$ each independently represent a halogen atom, an alkyl group having 1 to 5 carbon atoms, an alkoxy group having 1 to 5 carbon atoms, and an amino group substituted with an alkyl group having 1 to 2 carbon atoms, a substituted or unsubstituted aryl group, $—C(R^{T12})═C(R^{T13})(R^{T14})$, or $—CH═CH—CH═C(R^{T15})(R^{T16})$, and $R^{T12}$, $R^{T13}$, $R^{T14}$, $R^{T15}$, and $R^{T16}$ each independently represent a hydrogen atom, a substituted or unsubstituted alkyl group, or a substituted or unsubstituted aryl group. Tm1, Tm2, Tn1, and Tn2 each independently represent an integer of 0 to 2.

Examples of a substituent of each of the groups include a halogen atom, an alkyl group having 1 to 5 carbon atoms, and an alkoxy group having 1 to 5 carbon atoms. In addition, examples of the substituent of each of the groups also include a substituted amino group substituted with an alkyl group having 1 to 3 carbon atoms.

Here, in the triarylamine derivative expressed by the General Formula (a-1) and the benzidine derivative expressed by the General Formula (a-2), particularly, the triarylamine derivative having "$—C_6H_4—CH═CH—CH═C(R^{T7})(R^{T8})$" and a benzidine derivative having "$—CH═CH—CH═C(R^{T15})(R^{T16})$" are preferable from the viewpoint of charge mobility.

As the polymer charge transportation material, known materials such as poly-N-vinylcarbazole and polysilane which have a charge transporting property are used. Particularly, polyester-based polymeric charge transportation materials disclosed in JP-A-8-176293, JP-A-8-208820, and the like are particularly preferable. The polymeric charge transportation materials may be used alone or in combination with the binding resin.

A concentration of the charge transportation material which is measured on the surface of the charge transportation layer is preferably 0.4 to 0.6 times higher than a concentration of the charge transportation material which is measured at the center of the thickness of the charge transportation layer, more preferably 0.45 to 0.56 times, and still more preferably 0.45 to 0.54 times.

When a ratio of the concentration of the charge transportation material which is measured on the surface of the charge transportation layer, and the concentration of the charge transportation material which is measured at the center of the thickness of the charge transportation layer is within the above-described ranges, the charge transportation material is more contained on the center side of the thickness of the charge transportation layer in comparison to the surface of the charge transportation layer.

Since the charge transportation material include the hole transportation material, and the hole transportation material has a high positive polarity, when the charge transporting material including hole transportation material is much contained at the central portion of the thickness of the charge transportation layer, frictional charging to a positive polarity of a photoreceptor surface due to friction is more suppressed. According to this, even when the photoreceptor is charged at the time of image formation, streak-shaped unevenness is less likely to occur in a surface potential of the photoreceptor, and occurrence of streak-shaped image defects and a residual potential, which are caused by rubbing between the photoreceptor and a member that comes into contact with the photoreceptor due to vibration, are further suppressed.

Description will be given of a method of measuring a concentration ratio of charge transportation material in the charge transportation layer. The charge transportation layer is cut obliquely in a thickness direction, and in the cross-section, a portion corresponding to a surface of the charge transportation layer and a portion corresponding to the center of the thickness of the charge transportation layer are analyzed by microscopic infrared spectroscopy. From measurement results on the surface of the charge transportation layer, and at the center of the thickness of the charge transportation layer, "a peak (1583.5 $cm^{-1}$) area resulting from C═C stretching vibration of the charge transportation material ÷ a peak (1770 $cm^{-1}$) area resulting from C═O of the binding resin" is calculated. Calculation is performed by dividing the value obtained from the measurement result on the surface of the charge transportation layer by the value obtained from the measurement result at the center of the thickness of the charge transportation layer.

Examples of the method of setting the ratio of concentration of the charge transportation material which is measured on the surface of the charge transportation layer, and the concentration of the charge transportation material which is measured at the center of the thickness of the charge transportation layer within the above-described ranges include a method in which the charge transportation layer application solution is applied, and the charge transportation layer is formed by rapidly removing a solvent in the charge transportation layer application solution.

Examples of a method of rapidly removing the solvent in the charge transportation layer application solution include a method in which heating is performed while blowing wind to a surface of a coated film formed by the charge transportation layer application solution, and a method in which the thickness of the conductive base body is made to be small so that heat is likely to be transferred to the coated film formed by the charge transportation layer application solution, and the like.

—Fluorine-Containing Resin Particles—

Examples of the fluorine-containing resin particles include fluoroolefin homopolymer particles, and particles of two or more kinds of copolymers, specifically, particles of a copolymer of one kind or two or more kinds of fluoroolefins and a non-fluorine-based monomer (that is, a monomer having no fluorine atom).

Examples of fluoroolefins include perhaloolefins such as tetrafluoroethylene (TFE), perfluorovinyl ether, hexafluoropropylene (HFP), and chlorotrifluoroethylene (CTFE), non-perfluoroolefins such as vinylidene fluoride (VdF), and trifluoroethylene, vinyl fluoride, and the like. Among these, VdF, TFE, CTFE, HFP, and the like are preferable.

On the other hand, examples of the non-fluorine-based monomer include hydrocarbon-based olefins such as ethylene, propylene, and butene; alkyl vinyl ethers such as cyclohexyl vinyl ether (CHVE), ethyl vinyl ether (EVE), butyl vinyl ether, and methyl vinyl ether; alkenyl vinyl ethers such as polyoxyethylene allyl ether (POEAE) and ethyl allyl ether; organosilicon compounds having reactive α, β-unsaturated groups such as vinyltrimethoxysilane (VSi), vinyltriethoxysilane, and vinyltris(methoxyethoxy) silane; acrylic acid esters such as methyl acrylate and ethyl acrylate; methacrylic acid esters such as methyl methacrylate and ethyl methacrylate; vinyl esters such as vinyl acetate, vinyl benzoate, "VeoVa" (trade name, vinyl ester manufactured by Shell Co.); and the like. Among these, alkyl vinyl ether, allyl vinyl ether, vinyl ester, and organosilicon compounds having reactive α, β-unsaturated groups are preferable.

Among these, as the fluorine-containing resin particles, particles having a high fluorination rate are preferable, and particles such as polytetrafluoroethylene (PTFE), tetrafluoroethylene-hexafluoropropylene copolymer (FEP), tetrafluoroethylene-perfluoro(alkyl vinyl ether) copolymer (PFA), ethylene-tetrafluoroethylene copolymer (ETFE), ethylene-chlorotrifluoroethylene copolymer (ECTFE), and the like are more preferable, and particles of PTFE, FEP, and PFA are still more preferable.

In the fluorine-containing resin particles, the number of carboxylic groups is preferably 0 to 30 per $10^6$ carbon atoms, and more preferably 0 to 20 per $10^6$ carbon atoms.

Here, the carboxylic group of the fluorine-containing resin particles is, for example, a carboxylic group derived from terminal carboxylic acid contained in the fluorine-containing resin particles.

Examples of a method of reducing the amount of carboxyl groups in the fluorine-containing resin particles include 1) a method in which irradiation with radioactive rays is not performed in a process of manufacturing particles, 2) a method in which irradiation with radioactive rays is performed in a condition that oxygen does not exist or a condition in which an oxygen concentration is reduced, and the like.

As described in JP-A-4-20507 or the like, the amount of the carboxylic groups in the fluorine-containing resin particles is measured as follows.

The fluorine-containing resin particles were preliminarily molded with press machine to manufacture a film having a thickness of approximately 0.1 mm. Infrared absorption spectrum of the manufactured film was measured. With respect to fluorine-containing resin particles which are manufactured by bringing a fluorine gas into contact with the fluorine-containing resin particles to completely fluorinate the carboxylic acid terminal, the infrared absorption spectrum was also measured, and the number of the terminal carboxylic groups (per $10^6$ carbon atoms) is obtained from both difference spectrums by using an expression $(I \times K)/t$.

I: absorbance

K: correction coefficient t: film thickness (mm)

An absorption wavenumber of the carboxylic group is set to 3560 $cm^{-1}$, and the correction coefficient is set to 440.

Here, examples of the fluorine-containing resin particles include particles obtained upon irradiation with radioactive rays (in this specification, also referred to as "radioactive ray irradiation type fluorine-containing resin particles"), particles obtained by polymerization method (in this specification, also referred to as "polymerization type fluorine-containing resin particles"), and the like.

The radioactive ray irradiation type fluorine-containing resin particles (fluorine-containing resin particles obtained through irradiation with radioactive rays) show fluorine-containing resin particles granulated in combination with radioactive ray polymerization, and low quantified and atomized fluorine-containing resin particles due to decomposition of the fluorine-containing resin after polymerization through irradiation with radioactive rays.

Since a large amount of carboxylic acids are generated due to irradiation with radioactive rays in the air, the radioactive ray irradiation type fluorine-containing resin particles also contain a large amount of carboxylic groups.

On the other hand, the polymerization type fluorine-containing resin particles (fluorine-containing resin particles obtained by the polymerization method) show fluorine-containing resin particles which are granulated in combination with polymerization by a suspension polymerization method, an emulsion polymerization method, or the like, and are not irradiated with radioactive rays.

The fluorine-containing resin particles may be the polymerization type fluorine-containing resin particles. As described above, the polymerization type fluorine-containing resin particles are fluorine-containing resin particles which are granulated in combination with polymerization by the suspension polymerization method, the emulsion polymerization method, or the like, and are not irradiated with radioactive rays.

Here, manufacturing of the fluorine-containing resin particles by the suspension polymerization method relates to, for example, a method in which additives such as a polymerization initiator and a catalyst are suspended in a dispersion medium in combination with a monomer for forming the fluorine-containing resin, and then the polymer is made into particles while polymerizing the monomer.

In addition, manufacturing of the fluorine-containing resin particles by the emulsion polymerization method relates to, for example, a method in which additives such as a polymerization initiator and a catalyst are emulsified in a dispersion medium in combination with a monomer for forming the fluorine-containing resin by a surfactant (that is, an emulsifier), and then the polymer is made into particles while polymerizing the monomer.

Particularly, the fluorine-containing resin particles may be particles obtained without performing irradiation with radioactive rays in a manufacturing process.

However, radioactive ray irradiation type fluorine resin particles for which irradiation with radioactive rays is performed in a condition in which oxygen does not exist or an oxygen concentration is reduced may be applied as the fluorine resin particle.

An average particle size of the fluorine-containing resin particles is not particularly limited, and the average particle size is preferably 0.2 to 4.5 nm, and more preferably 0.2 to 4 μM.

The average particle size of the fluorine-containing resin particles is a value measured by the following method.

Observation is performed with a scanning electron microscope (SEM), for example, at magnification of 5000 or more times to measure a maximum diameter of the fluorine-containing resin particles (secondary particles after aggregation of primary particles), and an average value of maximum diameters of 50 particles is set as an average particle size of the fluorine-containing resin particles. Note that, as the SEM, JSM-6700F manufactured by JEOL Ltd., and a secondary electron image with an acceleration voltage of 5 kV is observed.

From the viewpoint of dispersion stability, a specific surface area (BET specific surface area) of the fluorine-containing resin particles is preferably 5 to 15 $m^2/g$, and more preferably 7 to 13 $m^2/g$.

Note that, the specific surface area is a value measured by a nitrogen substitution method by using BET type specific surface area measuring device (flow soap II2300, manufactured by Shimadzu Corporation).

From the viewpoint of dispersion stability, apparent density of the fluorine-containing resin particles is preferably 0.2 to 0.5 g/ml, and more preferably 0.3 to 0.45 g/ml.

Note that, the apparent density is a value that is measured in conformity to JIS K6891 (1995).

A melting temperature of the fluorine-containing resin particles is preferably 300° C. to 340° C., and more preferably 325° C. to 335° C.

Note that, the melting temperature is a melting point that is measured in conformity to JIS K6891 (1995).

In a case where the charge transportation layer is the outermost surface layer, from the viewpoint of suppressing occurrence of the streak-shaped image defects and the residual potential which are caused by rubbing between the photoreceptor and a member that comes into contact with the photoreceptor due to vibration, an occupancy area of the fluorine-containing resin particles which is measured on a surface of the charge transportation layer is preferably 0.33% to 1.1%, more preferably 0.36% to 0.95%, and still more preferably 0.38% to 0.90%.

The occupancy area of the fluorine-containing resin particles which is measured on the surface of the charge transportation layer is set within the above-described ranges, and a lot of the fluorine-containing resin particles having high negative polarity are made to exist on the surface of the charge transportation layer. According to this, even in a case where rubbing occurs between the photoreceptor and the member that comes into contact with the photoreceptor occurs due to vibration in transportation, a positive charge that occurs due to friction is likely to be cancelled, and frictional charging of a rubbed portion of the photoreceptor to positive polarity is suppressed. According to this, even when the photoreceptor is charged at the time of image formation, the streak-shaped unevenness is less likely to occur in a surface potential of the photoreceptor, and thus occurrence of the streak-shaped image defects and the residual potential which are caused by rubbing between the photoreceptor and a member that comes into contact with the photoreceptor due to vibration are further suppressed.

Description will be given of a method of measuring the occupancy area of the fluorine-containing resin particles. A surface range of 120 μm×90 μm in the charge transportation layer is observed with a scanning electron microscope (SEM) to calculate a total value of areas of the fluorine-containing resin particles exposed to the surface of the charge transportation layer, and the total value is divided by the observation area value (that is, 120 μm×90 μm) to calculate the occupancy area of the fluorine-containing resin particles.

The amount of the fluorine-containing resin particles contained is preferably 1% by mass to 20% by mass with respect to the charge transportation layer, more preferably 5% by mass to 15% by mass, and still more preferably 7% by mass to 10% by mass.

—Fluorine Atom Concentration—

In a case where the charge transportation layer is the outermost surface layer, in the photoreceptor according to this exemplary embodiment, a fluorine atom concentration measured on the surface of the charge transportation layer is 1.5 to 5.0 times a fluorine atom concentration measured at a depth of 1 μm from the surface of the charge transportation layer.

When the fluorine atom concentration of the charge transportation layer is set to the above-described configuration, a lot of the fluorine-containing resin particles are contained in the surface of the charge transportation layer, and thus occurrence of the streak-shaped image defects and the residual potential which are caused by rubbing between the photoreceptor and a member that comes into contact with the photoreceptor due to vibration are suppressed.

From the viewpoint of suppressing occurrence of the streak-shaped image defects and the residual potential which are caused by rubbing between the photoreceptor and a member that comes into contact with the photoreceptor due to vibration, the fluorine atom concentration measured on the surface of the charge transportation layer is preferably 2.0 to 5.0 times the fluorine atom concentration measured at a depth of 1 μm from the surface of the charge transportation layer, and more preferably 2.5 to 4.0 times.

Measurement of the fluorine atom concentration is performed by X-ray photoelectron spectroscopy (XPS). First, the surface of the charge transportation layer is analyzed with an XPS method, and the concentration of fluorine atoms in all elements is calculated. Next, sputtering is performed from the surface of the charge transportation layer to a depth of 1 μm, a portion at a depth of 1 μm from the surface of the charge transportation layer is exposed, and the surface is analyzed with the XPS method, and the concentration of fluorine atoms in all elements is calculated.

Note that, with regard to measurement conditions in the XPS, measurement is performed at a tube voltage of 40 kV and a tube current of 90 mA.

—Additive, Formation Method, and Film Thickness—

Other known additives may be contained in the charge transportation layer.

As the additives, for example, a dispersant is preferable.

As the dispersant, a dispersant including a fluorine element is preferable, and specific examples thereof include a fluorine-containing graft polymer.

Examples of the fluorine-containing graft polymer include a polymer obtained by homopolymerizing or copolymerizing a polymerizable compound having a fluorinated alkyl group (hereinafter, also referred to as "fluorinated alkyl group-containing polymer").

Specific examples of the fluorine-containing graft polymer include a homopolymer of (meth)acrylate having a fluorinated alkyl group, and a random or block copolymer of (meth)acrylate having a fluorinated alkyl group and a monomer that does not have a fluorine atom, and the like. Not that, the (meth)acrylate represents both acrylate and methacrylate.

Examples of the (meth)acrylate having a fluorinated alkyl group include 2,2,2-trifluoroethyl (meth)acrylate, and 2,2,3,3,3-pentafluoropropyl (meth)acrylate.

Examples of the monomer that does not have the fluorine atom include (meth)acrylate, isobutyl (meth)acrylate, t-butyl (meth)acrylate, isooctyl (meth)acrylate, lauryl (meth)acrylate, stearyl (meth)acrylate, isobornyl (meth)acrylate, cyclohexyl (meth)acrylate, 2-methoxyethyl (meth)acrylate, methoxytriethylene glycol (meth)acrylate, 2-ethoxyethyl (meth)acrylate, tetrahydrofurfuryl (meth)acrylate, benzyl (meth)acrylate, ethyl carbitol (meth)acrylate, phenoxyethyl (meth)acrylate, 2-hydroxy (meth)acrylate, 2-hydroxypropyl (meth)acrylate, 4-hydroxybutyl (meth)acrylate, methoxy polyethylene glycol (meth)acrylate, phenoxy polyethylene glycol (meth)acrylate, hydroxyethyl o-phenylphenol (meth) acrylate, o-phenylphenol glycidyl ether (meth)acrylate.

In addition, specific examples of the fluorine-containing graft polymer also include a block or branch polymer disclosed in specification of U.S. Pat. No. 5,637,142, Japanese Patent No. 4251662, and the like. In addition, specific examples of the fluorine-containing graft polymer also include a fluorine-based surfactant.

The amount of the fluorine-containing graft polymer contained is preferably 1.0% by mass to 15.0% by mass with respect to the amount of fluorine-containing resin particles contained, more preferably 2.0% by mass to 10.0% by mass, and still more preferably 3.0% by mass to 8.0% by mass.

In a case where the charge transportation layer is the outermost surface layer, when the kind of the fluorine-containing graft polymer and the amount of the fluorine-containing graft polymer contained are set as described above, a lot of the fluorine-containing resin particles are likely to be contained in the surface of the charge transportation layer, and thus the fluorine atom concentration of the charge transportation layer is likely to have the above-described configuration and is preferable.

Formation of the charge transportation layer is not particularly limited, and a known formation method is used. For example, the formation is performed as follows. A coated film of a charge transportation layer forming application solution obtained by adding the above-described components to a solvent is formed, and the coated film is dried and is heated as necessary.

Examples of the solvent for preparing the charge transportation layer forming application solution include aromatic hydrocarbons such as benzene, toluene, xylene, and chlorobenzene; ketones such as acetone and 2-butanone; halogenated aliphatic hydrocarbons such as methylene chloride, chloroform, and ethylene chloride; typical organic solvents such as cyclic or straight-chain ethers such as tetrahydrofuran and ethyl ether. These solvents are used alone, or two or more kinds thereof are mixed and used.

Examples of an application method for applying the charge transportation layer forming application solution onto the charge generation layer include typical methods such as a blade coating method, a wire bar coating method, a spray coating method, a dip coating method, a bead coating method, an air knife coating method, and a curtain coating method.

For example, the film thickness of the charge transportation layer is preferably set in a range of 5 to 50 μm, and more preferably in a range of 10 to 30 μm.

(Surface Protective Layer)

The surface protective layer is provided on the photosensitive layer as necessary. For example, the surface protective layer is provided to prevent chemical change of the photosensitive layer when being charged, or to further improve mechanical strength of the photosensitive layer.

Accordingly, a layer constituted by a cured film (crosslinked film) may be applicable to the surface protective layer. Examples of the layer include layers shown in the following 1) or 2).

1) A layer constituted by a cured film of a composition containing a reactive group-containing charge transportation material that has a reactive group and a charge transporting skeleton in the same molecule (that is, a layer containing a polymer or a crosslinked body of the reactive group-containing charge transportation material).

2) A layer constituted by a cured film of a composition containing a non-reactive charge transportation material, and a reactive group-containing non-charge transportation material that does not have a charge-transporting skeleton and has a reactive group (that is, a layer containing non-reactive charge transportation material and a polymer or crosslinked body of the reactive group-containing non-charge transportation material).

Examples of the reactive group of the reactive group-containing charge transportation material include known reactive groups such as a chain-polymerizable group, an epoxy group, —OH, —OR [provided that, R represents an alkyl group], —$NH_2$, —SH, —COOH, and —$SiR^{Q1}_{3-Qn}(OR^{Q2})_{Qn}$ [provided that, $R^{Q1}$ represents a hydrogen atom, an alkyl group, or a substituted or unsubstituted aryl group, and $R^{Q2}$ represents a hydrogen atom, an alkyl group, or a trialkylsilyl group. Qn represents an integer of 1 to 3].

The chain-polymerizable group is not particularly limited as long as the chain-polymerizable group is a radically polymerizable functional group, and is, for example, a functional group having a group having at least a carbon double bond. Specific examples thereof include a group containing at least one selected from a vinyl group, a vinyl ether group, a vinyl thioether group, a styryl group (vinyl phenyl group), an acryloyl group, a methacryloyl group, and derivatives thereof, and the like. The chain-polymerizable group is preferably a group containing at least one selected from the vinyl group, the styryl group (vinylphenyl group), the acryloyl group, the methacryloyl group, and derivatives thereof among the groups from the viewpoint that reactivity is excellent.

The charge-transporting skeleton of the reactive group-containing charge-transportation material is not particularly limited as long as the charge-transporting skeleton has a known structure in the electrophotographic photoreceptor, and examples thereof include a structure that is a skeleton derived from a nitrogen-containing hole transporting compound such as a triarylamine-based compound, a benzidine-based compound, and a hydrazone-based compound, and is conjugated with a nitrogen atom. Among these, the triarylamine skeleton is preferable.

The reactive group-containing charge transportation material having the reactive group and the charge transporting skeleton, the non-reactive charge transportation material, and the reactive group-containing non-charge transportation material may be selected from known materials.

Other known additives may be contained in the surface protective layer.

Formation of the surface protective layer is not particularly limited, and a known formation method is used. For example, the formation is performed as follows. A coated film of a surface protective layer forming application solution obtained by adding the above-described compounds to a solvent is formed, and the coated film is dried, and is subjected to a curing treatment such as heating as necessary.

Examples of the solvent for preparing the surface protective layer forming application solution include an aromatic solvent such as toluene and xylene; a ketone-based solvent such as methyl ethyl ketone, methyl isobutyl ketone, and cyclohexanone; an ester-based solvent such as ethyl acetate and butyl acetate; an ether-based solvent such as tetrahydrofuran and dioxane; a cellosolve solvent such as ethylene glycol monomethyl ether; an alcohol solvent such as isopropyl alcohol and butanol. These solvents are used alone or two or more kinds thereof are mixed and used.

Note that, the surface protective layer forming application solution may be a solvent-free application solution.

Examples of a method of applying the surface protective layer forming application solution onto the photosensitive layer (for example, the charge transportation layer) include typical methods such as a dip coating method, a push-up coating method, a wire bar coating method, a spray coating method, a blade coating method, a knife coating method, and a curtain coating method.

For example, the film thickness of the surface protective layer is preferably set in a range of 1 to 20 μm, and more preferably in a range of 2 to 10 μm. Note that, in a case where the surface protective layer is the outermost surface layer, the surface protective layer contains the fluorine-containing resin particles. The fluorine-containing resin particles contained in the surface protective layer are the same as the fluorine-containing resin particles, and thus detailed description on the fluorine-containing resin particles will be omitted.

(Single-Layer Type Photosensitive Layer)

The single-layer type photosensitive layer (the charge generation/charge transportation layer) is a layer that contains, for example, a charge generation material and a charge transportation material, and further contains a binding resin and other known additives as necessary. Note that, the materials are the same as the materials described in the charge generation layer and the charge transportation layer. In a case where the single-layer type photosensitive layer is the outermost surface, the single-layer type photosensitive layer contains the fluorine-containing resin particles In addition, in the single-layer type photosensitive layer, the amount of the charge generation material contained may be 0.1% by mass to 10% by mass with respect to a total solid content, and preferably 0.8% by mass to 5% by mass. In addition, in the single-layer type photosensitive layer, the amount of the charge transportation material contained may be 5% by mass to 50% by mass with respect to the total solid content.

A method of forming the single-layer type photosensitive layer is the same as the method of forming the charge generation layer or the charge transportation layer.

For example, the film thickness of the single-layer type photosensitive layer may be 5 to 50 μm, and preferably 10 to 40 μm.

<Image Forming Apparatus (and Process Cartridge)>

An image forming apparatus according to this exemplary embodiment includes an electrophotographic photoreceptor, a charge unit that charges a surface of the electrophotographic photoreceptor, an electrostatic latent image forming unit that forms an electrostatic latent image on the surface of the charged electrophotographic photoreceptor, a development unit that develops the electrostatic latent image formed on the surface of the electrophotographic photoreceptor by a developer containing a toner to form a toner image, and a transfer unit that transfers the toner image to a surface of a recording medium. In addition, as the electrophotographic photoreceptor, the photoreceptor according to this exemplary embodiment is applied.

As the image forming apparatus according to this exemplary embodiment, a known image forming apparatus such as an apparatus including a fixing unit that fixes the toner image transferred to the surface of the recording medium; a direct transfer type apparatus that directly transfers the toner image formed on the surface of the electrophotographic photoreceptor to the recording medium; an intermediate transfer type apparatus that primarily transfers the toner image formed on the surface of the electrophotographic photoreceptor to a surface of an intermediate transfer body, and secondarily transfers the toner image transferred to the surface of the intermediate transfer body to the surface of the recording medium; an apparatus including a cleaning unit that cleans the surface of the electrophotographic photoreceptor after transfer of the toner image and before charging; an apparatus including a charge removal unit that irradiates the surface of the electrophotographic photoreceptor with charge removal light to remove charges after transfer of the toner image and before charging; and an apparatus including an electrophotographic photoreceptor heating member for raising a temperature of the electrophotographic photoreceptor and reducing a relative temperature are applied.

In the case of the intermediate transfer type apparatus, for example, a configuration including an intermediate transfer body in which the toner image is transferred to a surface thereof, a primary transfer unit that primarily transfers the toner image formed on the surface of the electrophotographic photoreceptor to the surface of the intermediate transfer body, and a secondary transfer unit that secondarily transfers the toner image transferred to the surface of the intermediate transfer body to the surface of the recording medium is applied to the transfer unit.

The image forming apparatus according to this exemplary embodiment may be either a dry development type image forming apparatus or a wet development type (a development type using a liquid developer) image forming apparatus.

Note that, in the image forming apparatus according to this exemplary embodiment, for example, a portion provided with the electrophotographic photoreceptor may be a cartridge structure (process cartridge) that is attached and detached to and from the image forming apparatus. As the process cartridge, for example, a process cartridge including the photoreceptor according to this exemplary embodiment may be appropriately used. Note that, the process cartridge may be provided, for example, at least one selected from the group consisting of a charging unit, an electrostatic latent image forming unit, a development unit, and a transfer unit in addition to the electrophotographic photoreceptor.

Hereinafter, an example of the image forming apparatus according to this exemplary embodiment will be described, but there is no limitation thereto. Note that, main portions illustrated in the drawings, and description of other portions will be omitted.

Figure 2:
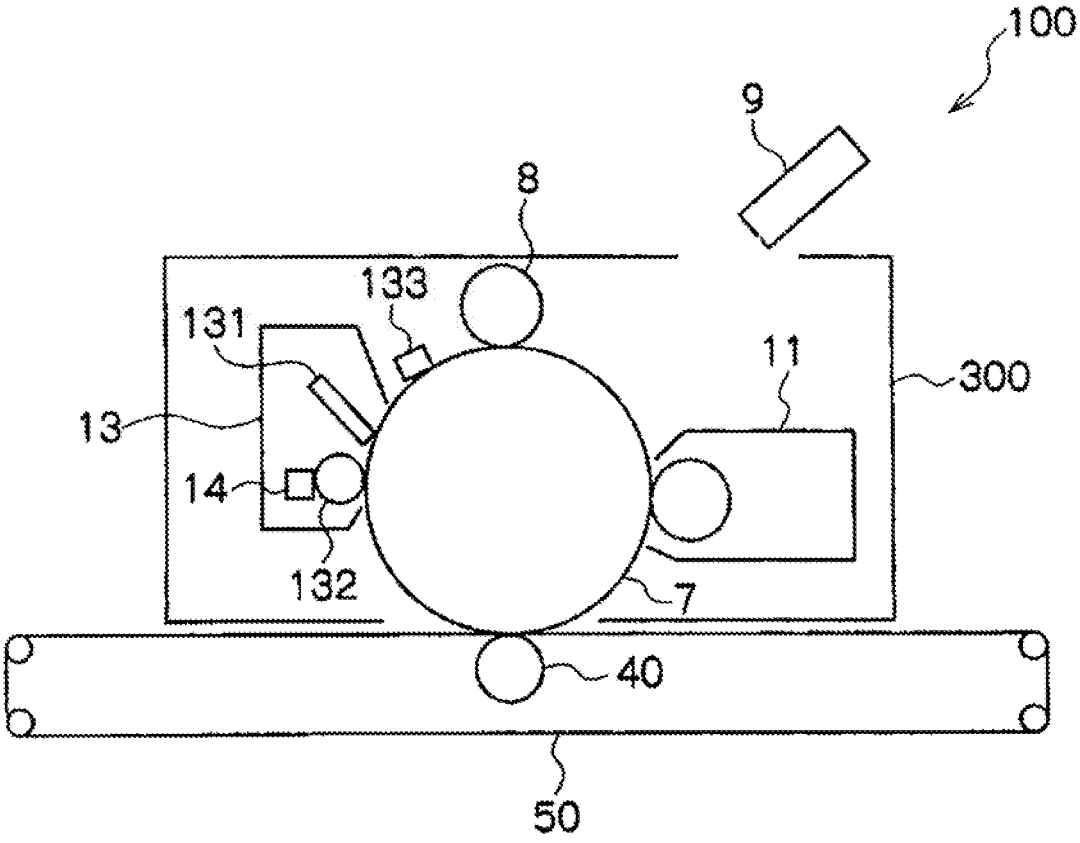
FIG. 2 is a schematic configuration diagram illustrating an example of an image forming apparatus according to first and second exemplary embodiments.

FIG. 2 is a schematic configuration diagram illustrating an example of the image forming apparatus according to this exemplary embodiment.

As illustrated in FIG. 2, an image forming apparatus 100 according to this exemplary embodiment includes a process cartridge 300 including an electrophotographic photoreceptor 7, an exposure device 9 (an example of an electrostatic latent image forming unit), a transfer device 40 (a primary transfer device), and an intermediate transfer body 50. Note that, in the image forming apparatus 100, the exposure device 9 is disposed at a position capable of being exposed to the electrophotographic photoreceptor 7 from an opening of the process cartridge 300, the transfer device 40 is disposed at a position that faces the electrophotographic photoreceptor 7 through the intermediate transfer body 50, and a part of the intermediate transfer body 50 is disposed in contact with the electrophotographic photoreceptor 7. Although not illustrated in the drawing, a secondary transfer device that transfers a toner image transferred to the intermediate transfer body 50 to a recording medium (for example, paper) is also provided. Note that, the intermediate transfer body 50, the transfer device 40 (primary transfer device), and the secondary transfer device (not illustrated) correspond to an example of a transfer unit.

The process cartridge 300 in FIG. 2 integrally supports the electrophotographic photoreceptor 7, a charging device 8 (an example of the charging unit), a development device 11 (an example of the development unit), and a cleaning device 13 (an example of the cleaning unit) in a housing. The cleaning device 13 includes a cleaning blade (an example of the cleaning member) 131, and the cleaning blade 131 is disposed to come into contact with a surface of the electrophotographic photoreceptor 7. Note that, the cleaning member may also be a conductive or insulating fiber-shaped member instead of the aspect of the cleaning blade 131, and the cleaning member may be used alone or in combination with the cleaning blade 131.

Note that, in FIG. 2, as the image forming apparatus, there is described an example in which a fiber-shaped member 132 (roll shape) that supplies a lubricant 14 to the surface of the electrophotographic photoreceptor 7, and a fiber-shaped member 133 (flat brush shape) that assists cleaning are provided, but these members are disposed in correspondence with necessity.

Hereinafter, respective configurations of the image forming apparatus according to this exemplary embodiment will be described.

—Charging Device—

As the charging device 8, for example, a contact type charger using a conductive or semi-conductive charging roller, a charging brush, a charging film, a charging rubber blade, a charging tube, or the like is used. In addition, a known charger such as a non-contact type roller charger, and a scorotron charger or a corotron charger using corona discharge, or the like also used.

—Exposure Device—

Examples of the exposure device 9 include an optical device that exposes the surface of the electrophotographic photoreceptor 7 with light such as semiconductor laser light, LED light, and liquid crystal shutter light in a determined image, and the like. A wavelength of a light source is set within spectral sensitivity region of the electrophotographic photoreceptor. As a wavelength of the semiconductor laser, near infrared having an oscillation wavelength in the vicinity of 780 nm may be used. However, there is no limitation to the wavelength, and a laser having an oscillation wavelength in an order of 600 nm or a laser having an oscillation wavelength at 400 to 450 nm as a blue laser may also be used. In addition, a surface light emission type laser light source in a type capable of outputting multi-beam for color image formation is also effective.

—Development Device—

Examples of the development device 11 include a typical development device that performs development through contact or non-contact with a developer. The development device 11 is not particularly limited as long as the above-described function is provided, and is selected in correspondence with the purpose. Examples of the development device 11 include a known development device having a function of attaching a one-component developer or two-component developer to the electrophotographic photoreceptor 7 by using a brush, a roller, or the like, and the like. Among these, a development roller that holds the developer on a surface may be used.

The developer that is used in the development device 11 may be a single-component developer of a toner alone or a two-component developer containing a toner and a carrier. The developer may be magnetic or non-magnetic. Known developers are applied to the developers.

—Cleaning Device—

As the cleaning device 13, a cleaning blade type device including the cleaning blade 131 is used.

It is preferable that the cleaning blade 131 is brought into contact with the electrophotographic photoreceptor 7 so that a contact pressure with respect to the electrophotographic photoreceptor 7 becomes 1.0 to 4.0 g/mm.

Here, the contact pressure with respect to the electrophotographic photoreceptor 7 indicates a load per unit length which is applied to a contact portion of the electrophotographic photoreceptor 7 by the cleaning blade 131, that is, a linear pressure.

When the contact pressure with respect to the electrophotographic photoreceptor 7 is within the above-described range, friction that occurs by rubbing between the electrophotographic photoreceptor 7 and the cleaning blade 131 due to vibration is reduced, and the surface of the electrophotographic photoreceptor 7 is less likely to be frictionally charged. As a result, occurrence of the streak-shaped image defects and a residual potential is suppressed, and thus the above-described range is preferable.

From the viewpoint of suppressing occurrence of the streak-shaped image defects and the residual potential which are caused by rubbing between the photoreceptor and a member that comes into contact with the photoreceptor due to vibration, the contact pressure of the cleaning blade 131 with respect to the electrophotographic photoreceptor 7 is more preferably 1.5 to 3.5 g/mm, and still more preferably 2.0 to 3.0 g/mm.

Note that, in addition to the cleaning blade type, a fur brush cleaning type, or a simultaneous development and cleaning type may be employed.

—Transfer Device—

Examples of the transfer device 40 include known transfer chargers such as a contact type transfer charger using a belt, a roller, a film, a rubber blade, or the like, and a scorotron transfer charger or a corotron transfer charger using corona discharge.

—Intermediate Transfer Body—

As the intermediate transfer body 50, a belt-shaped member (intermediate transfer belt) containing polyimide, polyamideimide, polycarbonate, polyarylate, polyester, rubber, or the like to which semiconductivity is applied is used. In addition, as a form of the intermediate transfer body, a drum-shaped member other than the belt-shaped member may be used.

Figure 3:
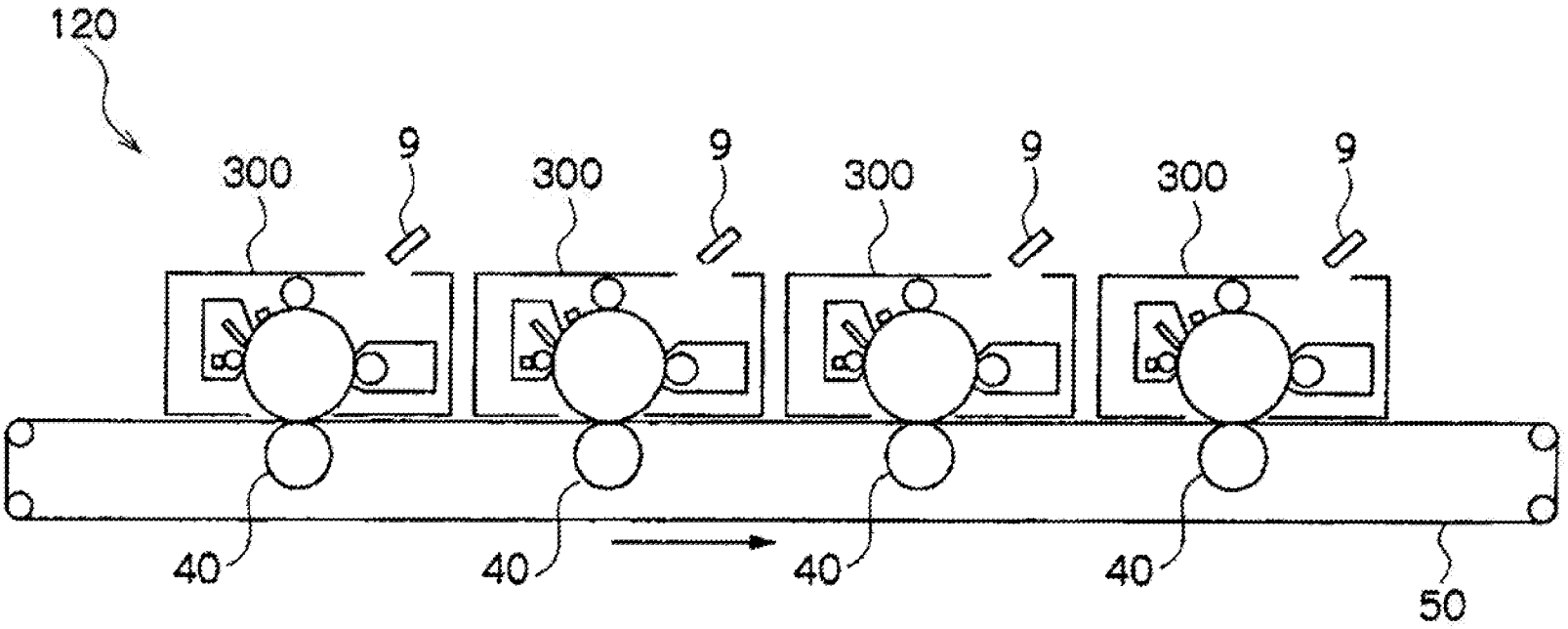
FIG. 3 is a schematic configuration diagram illustrating another example of the image forming apparatus according to the first and second exemplary embodiment.

FIG. 3 is a schematic configuration diagram illustrating another example of the image forming apparatus according to this exemplary embodiment.

An image forming apparatus 120 illustrated in FIG. 3 is a tandem type multi-color image forming apparatus on which four process cartridges 300 are mounted. In the image forming apparatus 120, four process cartridges 300 are arranged in parallel on an intermediate transfer body 50, and one electrophotographic photoreceptor is used for each color. Note that, the image forming apparatus 120 has a similar configuration as in the image forming apparatus 100 except for a tandem type.

Second Exemplary Embodiment

—Electrophotographic Photoreceptor—

An electrophotographic photoreceptor according to this exemplary embodiment includes a conductive base body, and a photosensitive layer provided on the conductive base body, and an outermost surface layer contains fluorine-containing resin particles.

In the electrophotographic photoreceptor according to this exemplary embodiment, a ratio (N2/N1) between a number density (N1) of aggregates of the fluorine-containing resin particles in a first region from a surface of the outermost surface layer to the half of the layer thickness, and a number density (N2) of aggregates of the fluorine-containing resin particles in a second region continuous from the half of the layer thickness from surface the outermost surface layer is less than 0.95.

In the electrophotographic photoreceptor according to this exemplary embodiment, a ratio (S2/S1) between an area ratio (S1) of the fluorine-containing resin particles in the first region from the surface of the outermost surface layer to the half of the layer thickness and an area ratio (S2) of the fluorine-containing resin particles in the second region continuous from the half of the layer thickness from the surface of the outermost surface layer is within a range of 1±0.1.

In the electrophotographic photoreceptor including the outermost surface layer that contains the fluorine-containing resin particles, the fluorine-containing resin particles plays a role of improving abrasion resistance when the cleaning blade and the outermost surface layer come into contact with each other. However, since the fluorine-containing resin particles tend to have high cohesiveness, a technique for dispersing the fluorine-containing resin particles in a nearly uniform state throughout the layer while suppressing aggregation of the fluorine-containing resin particles has been adopted in the outermost surface layer containing the fluorine-containing resin particles. However, when the fluorine-containing resin particles are dispersed in a nearly uniform state, the fluorine-containing resin particles tend to physically inhibit the charge transportation property of the outermost surface layer. As a result, the charge transportation property in the outermost surface layer when being exposed to the electrophotographic photoreceptor tends to decrease, that is, the sensitivity tends to decrease.

On the other hand, the electrophotographic photoreceptor according to this exemplary embodiment is excellent in both the sensitivity and the abrasion resistance due to the above-described configuration. The main cause of this is not clear, but it may be assumed as follows.

The electrophotographic photoreceptor according to this exemplary embodiment, the ratio (N2/N1) between the number density (N1) of aggregates of the fluorine-containing resin particles in the first region from the surface of the outermost surface layer to the half of the layer thickness, and the number density (N2) of aggregates of the fluorine-containing resin particles in the second region continuous from the half of the layer thickness from surface the outermost surface layer is less than 0.95. That is, between the first region (a surface side that comes into contact with the cleaning blade) and the second region (conductive base body side), in the first region, the number of aggregates of the fluorine-containing resin particles is smaller, and the fluorine-containing resin particles are dispersed in a nearly uniform state. According to this, the abrasion resistance is exhibited on the surface side that comes into contact with the cleaning blade. In addition, since the number of aggregates in the second region is larger, a region in which the fluorine-containing resin particles do not exist is enlarged, and physical inhibition on the charge transportation property of the outermost surface layer due to the fluorine-containing resin particles is suppressed. As a result, it is considered that deterioration of sensitivity is suppressed.

In the electrophotographic photoreceptor according to this exemplary embodiment, the ratio (S2/S1) between the area ratio (S1) of the fluorine-containing resin particles in the first region and the area ratio (S2) of the fluorine-containing resin particles in the second region continuous is within a range of 1±0.1 or less. That is, in the first region (surface side that comes into contact with the cleaning blade) and the second region (conductive base body side), the amount of the fluorine-containing resin particles existing is approximately the same regardless of the degree of aggregation. According to this, for example, even in a case where the electrophotographic photoreceptor according to this exemplary embodiment is driven for a long period of time, it is considered that the abrasion resistance is excellent.

<<Layer Configuration of Electrophotographic Photoreceptor>>

Hereinafter, a layer configuration of the electrophotographic photoreceptor will be described with reference to the accompanying drawings.

Figure 4:
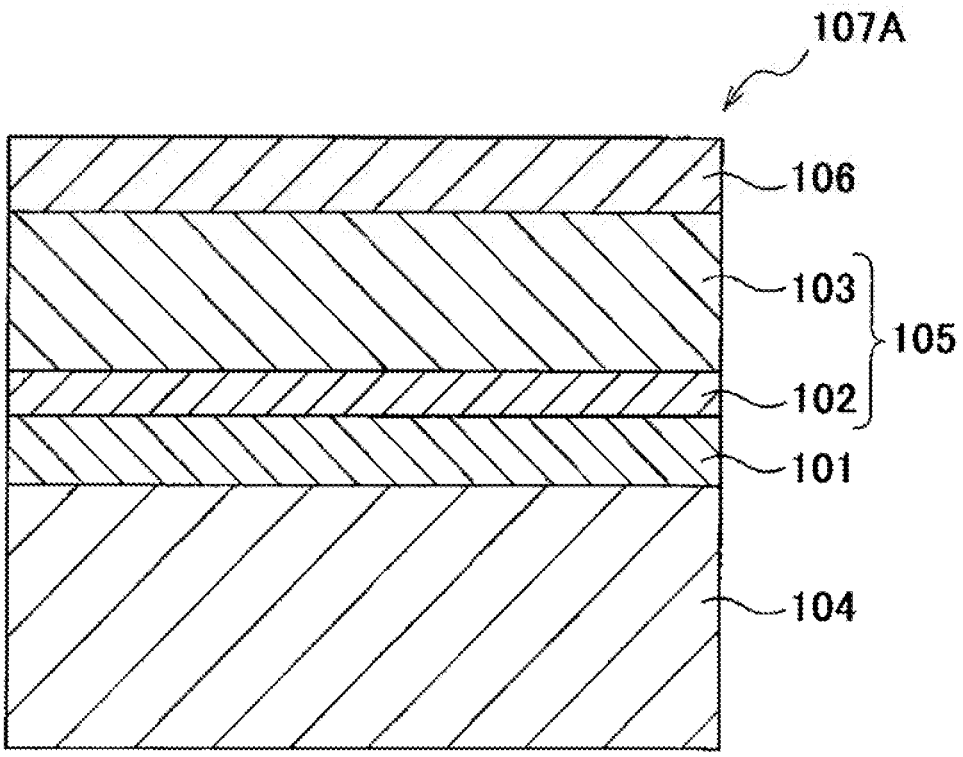
FIG. 4 is a schematic cross-sectional view illustrating an example of a layer configuration of an electrophotographic photoreceptor according to the second exemplary embodiment.

FIG. 4 is a schematic cross-sectional view illustrating an example of the layer configuration of the electrophotographic photoreceptor according to this exemplary embodiment. An electrophotographic photoreceptor 107A has a structure in which an undercoat layer 101 is provided on a conductive base body 104, a charge generation layer 102, a charge transportation layer 103, and a surface protective layer 106 are sequentially formed on the undercoat layer 101. The electrophotographic photoreceptor 107A includes a photosensitive layer 105 of which functions are divided to the charge generation layer 102 and the charge transportation layer 103. Hereinafter, the electrophotographic photoreceptor 107A including the stack type photosensitive layer 105 as illustrated in FIG. 4 is also referred to as "stack type photoreceptor".

Figure 5:
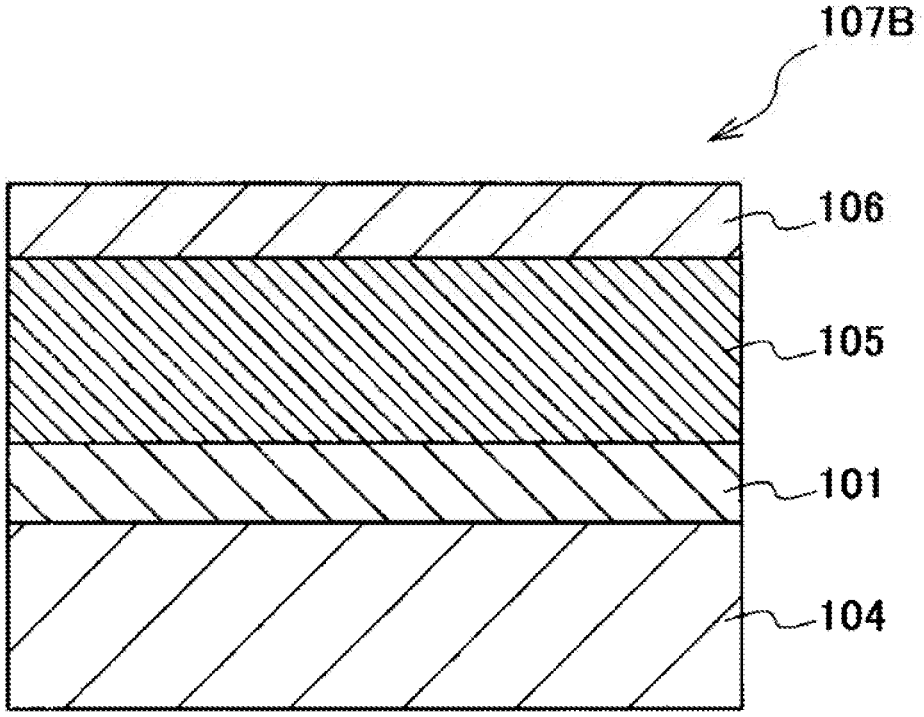
FIG. 5 is a schematic cross-sectional view illustrating another example of the layer configuration of the electrophotographic photoreceptor according to the second exemplary embodiment.

FIG. 5 is a schematic cross-sectional view illustrating another example of the layer configuration of the electrophotographic photoreceptor according to this exemplary embodiment. An electrophotographic photoreceptor 107B has a structure in which an undercoat layer 101 is provided on a conductive base body 104, and a photosensitive layer 105 and a surface protective layer 106 are sequentially formed on the undercoat layer 101. The electrophotographic photoreceptor 107B includes a single-layer type photosensitive layer in which the charge generation material and the charge transportation material are contained in the same photosensitive layer 105 and functions thereof are integrated. Hereinafter, the electrophotographic photoreceptor 107B including the single-layer type photosensitive layer 105 as described in FIG. 5 is also referred to as "single-layer type photoreceptor".

In the electrophotographic photoreceptor according to this exemplary embodiment, the undercoat layer 101 and the surface protective layer 106 may be provided or may not be provided.

Hereinafter, respective layers of the electrophotographic photoreceptor according to this exemplary embodiment will be described in detail. Note that, the conductive base body 104, the undercoat layer 101, the intermediate layer, the charge generation layer 102, and the single-layer type photosensitive layer according to the second exemplary embodiment have the same configurations as in the first exemplary embodiment, and thus description thereof will be omitted. Note that, a reference numeral will be omitted in description.

<<Outermost Surface Layer>>

The electrophotographic photoreceptor according to this exemplary embodiment contains the fluorine-containing resin particles in an outermost surface layer.

In the electrophotographic photoreceptor according to this exemplary embodiment, a ratio (N2/N1) between a number density (N1) of aggregates of the fluorine-containing resin particles in a first region from a surface of the outermost surface layer to the half of the layer thickness, and a number density (N2) of aggregates of the fluorine-containing resin particles in a second region continuous from the half of the layer thickness from surface the outermost surface layer is less than 0.95.

In the electrophotographic photoreceptor according to this exemplary embodiment, a ratio (S2/S1) between an area ratio (S1) of the fluorine-containing resin particles in the first region from the surface of the outermost surface layer to the half of the layer thickness and an area ratio (S2) of the fluorine-containing resin particles in the second region continuous from the half of the layer thickness from the surface of the outermost surface layer is within a range of 1±0.1.

In a case where the electrophotographic photoreceptor includes a surface protective layer, the outermost surface layer represents the surface protective layer.

In a case where the electrophotographic photoreceptor is a stack type photoreceptor that does not include the surface protective layer, the outermost surface layer represents a charge transportation layer.

In a case where the electrophotographic photoreceptor is a single-layer type photoreceptor that does not include the surface protective layer, the outermost surface layer represents a photosensitive layer.

[State of Outermost Surface Layer]

"Aggregate of fluorine-containing resin particles" represents a group of primary particles of the fluorine-containing resin particles in which an inter-particle distance is within 1 lam. However, in a case where particles do not exist within 1 μm around each of the primary particles, one piece of the primary particle is counted as one aggregate.

The primary particles constitute an aggregate may be exist in a region within 1 μm, and may be in one state among a state in which particles are in contact with each other, a state in which particles are not in contact with each other and are adjacent to each other, and a state including the both states.

The inter-particle distance represents the shortest linear distance when two arbitrary points on outer edges (surfaces) of adjacent primary particles are connected.

For example, in a case where an aggregate exists on a boundary line between the first region and the second region, or on a boundary line between the second region and a third region, the aggregate is counted as existing in a region in which the aggregate occupies a large area.

(Ratio Between Number Densities of Aggregates of Fluorine-Containing Resin Particles in Respective Regions)

Ratio (N2/N1)

The electrophotographic photoreceptor according to this exemplary embodiment, the ratio (N2/N1) between the number density (N1) of aggregates of the fluorine-containing resin particles in the first region from the surface of the outermost surface layer to the half of the layer thickness, and the number density (N2) of aggregates of the fluorine-containing resin particles in the second region continuous from the half of the layer thickness from surface the outermost surface layer is less than 0.95, preferably 0.1 to 0.8, and more preferably 0.2 to 0.7 from the viewpoint of an electrophotographic photoreceptor excellent in both the sensitivity and the abrasion resistance.

Ratio (N3/N1)

In the electrophotographic photoreceptor according to this exemplary embodiment, from the viewpoint of an electrophotographic photoreceptor excellent in both the sensitivity and the abrasion resistance, and from the viewpoint of suppressing occurrence of a color point caused by mixing-in of needle-shaped foreign matters, a ratio (N3/N1) between the number density (N1) of aggregates of the fluorine-containing resin particles in the first region from the surface of the outermost surface layer to the half of the layer thickness, and the number density (N3) of aggregates of the fluorine-containing resin particles in a third region continuous from 9/10 of the layer thickness from the surface of the outermost surface layer is preferably 0.9 or less, and more preferably 0.7 or less. The ratio (N3/N1) is also preferably 0.2 to 0.8, and more preferably 0.3 to 0.7.

In the related art, in the electrophotographic photoreceptor, when needle-shaped conductive foreign matters such as carbon fiber are mixed in, the foreign matters pierce the outermost surface layer, and a pierced region is dielectrically broken down due to a voltage from a charging member, and a leakage current is likely to occur. In a region in which the leakage current occurs, charging becomes defective, and a color point occurs when an image is formed. This phenomenon is particularly remarkable in an electrophotographic photoreceptor including the outermost surface layer (particularly, charge transportation layer) including the fluorine-containing resin particles, and an interface between the fluorine-containing resin particles and a resin is electrically weak and dielectric breakdown is likely to occur.

On the other hand, in the electrophotographic photoreceptor according to this exemplary embodiment, particularly, since the ratio (N3/N1) is set within the above-described range, the number density of the aggregates of the fluorine-containing resin particles in the second region becomes lower. According to this, even in a case where piercing of the conductive foreign matters occurs, the dielectric breakdown is less likely to occur. As a result, it is considered that occurrence of the color point due to the leakage current is suppressed.

Respective Number Densities (N1, N2, and N3)

From the viewpoint of an electrophotographic photoreceptor excellent in both the sensitivity and the abrasion resistance, the number density (N1) of aggregates of the fluorine-containing resin particles in the first region from the surface of the outermost surface layer to the half of the layer thickness is preferably 5 to 50 pieces/100 $\mu m^2$, more preferably 6 to 30 pieces/100 $\mu m^2$, and still more preferably 8 to 20 pieces/100 $\mu m^2$.

A method of adjusting the ratio (N2/N1) of the number density of aggregates of the fluorine-containing resin particles, and the ratio (N3/N1) in respective regions is not particularly limited, and examples thereof include, in the formation of the outermost surface layer, (1) a method of adjusting the number of times of treatment with a homogenizer when preparing an application solution that contains fluorine-containing resin particles; (2) a method of adjusting the amount or the kind of the fluorine-containing resin particles; (3) a method of forming coated films having a concentration difference step by step by using plural application solutions different in a solid content concentration of the fluorine-containing resin particles while adjusting the amount of the fluorine-containing resin particles contained in the outermost surface layer; (4) a method of adjusting a drying temperature of a coated film step by step; (5) a method of increasing a relative speed between a member to be coated and the application solution in the application; and the like.

A method of adjusting the number densities (N1 to N3) of aggregates of the fluorine-containing resin particles in the respective regions is not particularly limited, and examples thereof include, in formation of the outermost surface layer, (1) a method of adjusting the number of times of treatment with a homogenizer when preparing an application solution that contains fluorine-containing resin particles; (2) a method of adjusting the amount or the kind of the fluorine-containing resin particles; (3) a method of forming coated films having a concentration difference step by step by using plural application solutions different in the solid content concentration of the fluorine-containing resin particles while adjusting the amount of the fluorine-containing resin particles contained in the outermost surface layer; (4) a method of adjusting a drying temperature of a coated film step by step; (5) a method of increasing a relative speed between a member to be coated and the application solution in the application; and the like.

The number densities (N1 to N3) of aggregates of the fluorine-containing resin particles, and the ratios (N2/N1 and N3/N1) in the outermost surface layer are confirmed as follows.

(1) The outermost surface layer in the electrophotographic photoreceptor is cut out in a thickness direction to obtain a test specimen in which the cross-section is set as an observation surface.

(2) The observation surface of the test specimen is observed with a scanning electron microscope (SEM) (JSM-6700F, manufactured by JEOL Ltd.) to capture an image, the number of aggregates of the fluorine-containing resin particles in the first region from the surface (that is, layer thickness of 0 μm) of the outermost surface layer to the half of the layer thickness is counted through image analysis, and a value converted into a number per unit area is obtained as the number density (N1) of the fluorine-containing resin particles. Similarly, the number of aggregates of the fluorine-containing resin particles in each of the second region and the third region is counted, and a value converted into a number per unit area is obtained.

(3) (1) and (2) are performed with respect to arbitrary three cross-sections of the outermost surface layer in the electrophotographic photoreceptor, and arithmetic average values thereof are set as the number densities (N1, N2, and N3) of the fluorine-coating resin particles in the respective regions.

(4) The ratio (N2/N1) and the ratio (N3/N1) are respectively obtained.

(Ratio of Area Ratios of Fluorine-Containing Resin Particles in Respective Regions)

Ratio (S2/S1)

In the electrophotographic photoreceptor according to this exemplary embodiment, from the viewpoint of an electrophotographic photoreceptor excellent in the abrasion resistance, the ratio (S2/S1) between the area ratio (S1) of the fluorine-containing resin particles in the first region from the surface of the outermost surface layer to the half of the layer thickness and the area ratio (S2) of the fluorine-containing resin particles in the second region continuous from the half of the layer thickness from the surface of the outermost surface layer is within a range of 1±0.1, preferably 0.97 to 1.07, and more preferably 0.95 to 1.05.

A method of adjusting the ratio (S2/S1) of the area ratio of the fluorine-containing resin particles in the respective regions is not particularly limited, and examples thereof include, in formation of the outermost surface layer, (1) a method of adjusting the number of times of treatment with a homogenizer when preparing an application solution that contains fluorine-containing resin particles; (2) a method of adjusting the amount or the kind of the fluorine-containing resin particles; (3) a method of forming coated films having a concentration difference step by step by using plural application solutions different in the solid content concentration of the fluorine-containing resin particles while adjusting the amount of the fluorine-containing resin particles contained in the outermost surface layer; (4) a method of adjusting a drying temperature of a coated film step by step; (5) a method of increasing a relative speed between a member to be coated and the application solution in the application; and the like.

The ratio (S2/S1) of the area ratios of aggregates of the fluorine-containing resin particles may be confirmed as follows.

(1) The outermost surface layer in the electrophotographic photoreceptor is cut out in a thickness direction to obtain a test specimen in which the cross-section is set as an observation surface.

(2) The observation surface of the test specimen is observed with a scanning electron microscope (SEM) (S-4100, manufactured by Hitachi, Ltd.) to capture an image, and the image is input to an image analyzer (LUZEXIII, manufactured by NIRECO CORPORATION). In addition, a total area of aggregates of all fluorine-containing resin particles is obtained in the first region from the surface (that is, layer thickness of 0 μm) of the outermost surface layer to the half of the layer thickness through image analysis. In addition, an area ratio of aggregates of the fluorine-containing resin particles with respect to the area of the first region is obtained. Similarly, an area ratio of aggregates of the fluorine-containing resin particles in the second region is obtained.

(3) The above (1) and (2) are performed with respect to arbitrary three cross-sections of the outermost surface layer in the electrophotographic photoreceptor, and arithmetic average values of area ratios obtained with respect to the three cross-sections are set as the area ratios S1 and S2 of the fluorine-coating resin particles in the respective first and second regions.

(4) The ratio (S2/S1) is obtained.

(Ratio of Average Diameter of Aggregates of Fluorine-Containing Resin Particles in Respective Regions)

Ratio (D2/D1)

In the electrophotographic photoreceptor according to this exemplary embodiment, from the viewpoint of an electrophotographic photoreceptor excellent in both the sensitivity and the abrasion resistance, and from the viewpoint of suppressing occurrence of a color point caused by mixing-in of needle-shaped foreign matters, a ratio (D2/D1) between an average diameter (D1) of aggregates of the fluorine-containing resin particles in the first region from the surface of the outermost surface layer to the half of the layer thickness and an average diameter (D2) of aggregates of the fluorine-containing resin particles in the second region continuous from the half of the layer thickness from the surface of the outermost surface layer is preferably 2 or greater, more preferably 3 to 30, and still more preferably 5 to 30.

A method of adjusting the ratio (D2/D1) of the average diameters of aggregates of the fluorine-containing resin particles in the respective regions is not particularly limited, and examples thereof include, in formation of the outermost surface layer, (1) a method of adjusting the number of times of treatment with a homogenizer when preparing an application solution that contains fluorine-containing resin particles; (2) a method of adjusting the amount or the kind of the fluorine-containing resin particles; (3) a method of forming coated films having a concentration difference step by step by using plural application solutions different in a solid content concentration of the fluorine-containing resin particles while adjusting the amount of the fluorine-containing resin particles contained in the outermost surface layer; (4) a method of adjusting a drying temperature of a coated film step by step; (5) a method of increasing a relative speed between a member to be coated and the application solution in the application; and the like.

The ratio (D2/D1) of the average diameters of aggregates of the fluorine-containing resin particles may be confirmed as follows.

(1) The outermost surface layer in the electrophotographic photoreceptor is cut out in a thickness direction to obtain a test specimen in which the cross-section is set as an observation surface.

(2) The observation surface of the test specimen is observed with a scanning electron microscope (SEM) (S-4100, manufactured by Hitachi, Ltd.) to capture an image, and the image is input to an image analyzer (LUZEXIII, manufactured by NIRECO CORPORATION). In addition, an area for every aggregate of all fluorine-containing resin particles is obtained in the first region from the surface (that is, layer thickness of 0 μm) of the outermost surface layer to the half of the layer thickness through image analysis. In addition, an equivalent circle diameter of each aggregate is calculated from this area value, and 50% diameter (D50) in number-based cumulative frequency of the obtained equivalent circle diameter is set as an average diameter (D1) of aggregates of the fluorine-containing resin particles in the first region. Similarly, an average diameter (D2) of aggregates of the fluorine-containing resin particles in the second region is obtained.

(3) The ratio (D2/D1) is obtained.

(Primary Particle Size of Fluorine-Containing Resin Particles in Respective Regions)

In the electrophotographic photoreceptor according to this exemplary embodiment, from the viewpoint of an electrophotographic photoreceptor excellent in both the sensitivity and the abrasion resistance, and from the viewpoint of suppressing occurrence of a color point caused by mixing-in of needle-shaped foreign matters, a primary particle size (D11) of the fluorine-containing resin particles in the first region from the surface of the outermost surface layer to the half of the layer thickness, and a primary particle size (D12) of the fluorine-containing resin particles in the second region continuous from the half of the layer thickness from the surface of the outermost surface layer are preferably 20 to 800 nm, more preferably 50 to 600 nm, and still more preferably 100 to 500 nm.

The primary particle size (D11 or D12) of the fluorine-containing resin particles in the respective regions may be confirmed as follows.

(1) The outermost surface layer in the electrophotographic photoreceptor is cut out in a thickness direction to obtain a test specimen in which the cross-section is set as an observation surface.

(2) The observation surface of the test specimen is observed with a scanning electron microscope (SEM) (S-4100, manufactured by Hitachi, Ltd.) to capture an image, and the image is input to an image analyzer (LUZEXIII, manufactured by NIRECO CORPORATION). In addition, an area of each of all fluorine-containing resin particles (primary particles) in the first region from the surface (that is, layer thickness of 0 μm) of the outermost surface layer to the half of the layer thickness is obtained through image analysis. In addition, an equivalent circle diameter of the primary particle is calculated from the area value, and 50% diameter (D50) in number-based cumulative frequency of the obtained equivalent circle diameter is set as the primary particle size (D11) of the fluorine-containing resin particles in the first region. Similarly, a primary particle size (D12) of the fluorine-containing resin particles in the second region is obtained.

[Fluorine-Containing Resin Particles]

The outermost surface layer contains the fluorine-containing resin particles. The fluorine-containing resin particles may be used alone or in combination of two or more kinds.

Carboxylic Group

It is preferable that the fluorine-containing resin particles do not contain a carboxy group, or contains the carboxy group in a minute amount. Specifically, from the viewpoint of an electrophotographic photoreceptor excellent in charging properties, the number of carboxy groups in the fluorine-containing resin particles is preferably 0 to 30 per $10^6$ carbon atoms, and more preferably 0 to 20.

The carboxy group of the fluorine-containing resin particles represents a carboxy group derived from the terminal carboxylic acid contained in the fluorine-containing resin particles.

A method of reducing the amount of carboxy groups in the fluorine-containing resin particles is not particularly limited, and examples thereof include (1) a method in which irradiation with radioactive rays is not performed in a process of forming particles of the fluorine-containing resin, (2) a method in which irradiation with radioactive rays is performed in a condition that oxygen does not exist or a condition in which an oxygen concentration is reduced, and the like.

As described in JP-A-4-20507 or the like, the amount of the carboxy groups in the fluorine-containing resin particles is measured as follows. The fluorine-containing resin particles are preliminarily molded with press machine to manufacture a film having a thickness of approximately 0.1 mm. Infrared absorption spectrum of the manufactured film is measured. With respect to fluorine-containing resin particles which are manufactured by bringing a fluorine gas into contact with the fluorine-containing resin particles to completely fluorinate the carboxylic acid terminal, the infrared absorption spectrum is also measured, and the number of the terminal carboxylic groups (per $10^6$ carbon atoms) is obtained from both difference spectrums by using the following expression.

Number of terminal carboxylic groups (per $10^6$ carbon atoms)=(I×K)/t

I: absorbance

K: correction coefficient t: film thickness (mm)

An absorption wavenumber of the carboxylic group is set to 3560 $cm^{-1}$, and the correction coefficient is set to 440.

Basic Compound

It is preferable that the fluorine-containing resin particles do not contain a basic compound or contains the basic compound in a minute amount. Specifically, from the viewpoint of an electrophotographic photoreceptor excellent in charging properties, the amount of the basic compound in the fluorine-containing resin particles is preferably 0 to 3 ppm, more preferably 0 to 1.5 ppm, and still more preferably 0 to 1.2 ppm. Note that, ppm is based on mass.

Specific examples of the basic compound contained in the fluorine-containing resin particles include 1) a basic compound derived from a polymerization initiator used when the fluorine-containing resin particles are made into particle in combination with polymerization, 2) a basic compound used in a aggregation process after the polymerization, 3) a basic compound used as a dispersion assistant for stabilizing the dispersion solution after polymerization, and the like.

Examples of the basic compound include an amine compound; a hydroxide of an alkali metal or an alkaline earth metal; an oxide of an alkali metal or an alkaline earth metal; acetates (for example, particularly, amine compounds); and the like.

The basic compound may be a basic compound having a boiling point (a boiling point under normal pressure (1 atmospheric pressure)) of 40° C. to 130° C. (preferably, 50° C. to 110° C., and more preferably 60° C. to 90° C.).

Examples of the amine compound include a primary amine compound, a secondary amine compound, and a tertiary amine compound.

Examples of the primary amine compound include methylamine, ethylamine, propylamine, isopropylamine, n-butylamine, isobutylamine, t-butylamine, hexylamine, 2-ethylhexylamine, secondary butylamine, allylamine, methylhexylamine, and the like.

Examples of the secondary amine compound include dimethylamine, diethylamine, di-n-propylamine, diisopropylamine, di-n-butylamine, diisobutylamine, di-t-butylamine, dihexylamine, di(2-ethylhexyl)amine, N-isopropyl-N-isobutylamine, di(2-ethylhexyl)amine, di-secondary butylamine, diallylamine, N-methylhexylamine, 3-pipecoline, 4-pipecoline, 2,4-lupetidine, 2,6-lupetidine, 3,5-lupetidine, morpholine, N-methylbenzylamine, and the like.

Examples of the tertiary amine compound include trimethylamine, triethylamine, tri-n-propylamine, triisopropylamine, tri-n-butylamine, triisobutylamine, tri-t-butylamine, trihexylamine, tri(2-ethylhexyl)amine, N-methylmorpholine, N,N-dimethylallylamine, N-methyldiallylamine, triallylamine, N,N-dimethylallylamine, N,N,N',N'-tetramethyl-1,2-di aminoethane, N,N,N',N'-tetramethyl-1,3-diaminopropane, N,N,N',N'-tetraallyl -1,4-diaminobutane, N-methylpiperidine, pyridine, 4-ethylpyridine, N-propyldiallylamine, 3-dimethylaminopropanol, 2-ethylpyrazine, 2,3-dimethylpyrazine, 2,5-dimethylpyrazine, 2,4-lutidine, 2,5-lutidine, 3,4-lutidine, 3,5-lutidine, 2,4,6-collidine, 2-methyl-4-ethylpyridine, 2-methyl-5-ethylpyri dine, N,N,N',N'-tetramethylhexamethyl enedi amine, N-ethyl-3-hydroxypiperidine, 3-methyl-4-ethylpyridine, 3-ethyl-4-methylpyridine, 4-(5-nonyl)pyridine, imidazole, N-methylpiperazine, and the like.

Examples of the hydroxide of an alkali metal or an alkaline earth metal include NaOH, KOH, $Ca(OH)_2$, $Mg(OH)_2$, $Ba(OH)_2$, and the like.

Examples of the oxide of an alkali metal or an alkaline earth metal include CaO, MgO, and the like.

Examples of the acetates include zinc acetate, sodium acetate, and the like.

A method of reducing the amount of the basic compound contained in the fluorine-containing resin particles is not particularly limited, and examples thereof include (1) after particles are manufactured, the particles are washed with water, an organic solvent (alcohol such as methanol, ethanol, and isopropanol, tetrahydrofuran, or the like), (2) after manufacturing particles, the particles are heated (for example, heated to 200° C. to 250° C.) to decompose or vaporize the basic compound so as to remove the basic compound; and the like.

The amount of the basic compound contained in the fluorine-containing resin particles is measured as follows.

—Pretreatment—

In the case of performing measurement on the outermost surface layer containing the fluorine-containing resin particles, a sample of the outermost surface layer is immersed in a solvent (for example, tetrahydrofuran) to dissolve the fluorine-containing resin particles and substances other than a substance insoluble in the solvent in the solvent (for example, tetrahydrofuran). Then, the resultant mixture is added dropwise to pure water to filter precipitates. A solution containing PFOA obtained at that time is collected. In addition, an insoluble substance obtained by filtration is dissolved in a solvent and is added dropwise to pure water to filter precipitates. This operation is repeated five times in total. Then, the fluorine-containing resin particles (800 mg) is added into chloroform (1.5 mL), and the basic compound is eluted from the fluorine-containing resin particles to obtain a measurement sample.

—Measurement—

On the other hand, a basic compound solution (methanol solvent) of which a concentration is known is used, and gas chromatography is used. A calibration curve (a calibration curve from 0 to 100 ppm) is obtained from the basic compound concentration and a peak area value of the basic compound solution (methanol solvent) of which the concentration is known.

The measurement sample is measured by the gas chromatography, and the amount of the basic compound of the measurement sample is calculated from the peak area and the calibration curve which are obtained. The amount of the basin compound in the fluorine-containing resin particles is calculated by dividing the calculated amount of the basic compound of the measurement sample by the amount of fluorine-containing resin particles. Measurement conditions are as follows.

—Measurement Condition—

Headspace Sampler: (HP7694, manufactured by HP Development Company, L.P.)

Measurement device: gas chromatography (HP6890 series, manufactured by HP Development Company, L.P.)

Detector: hydrogen flame ionization detector (FID)

Column: (HP190915-433, manufactured by HP Development Company, L.P.)

Sample heating time: 10 min

Sprit Ratio: 300:1

Flow rate: 1.0 ml/min

Column temperature rising setting: 60° C. (3 min), 60° C./min, 200° C. (1 min)

Fluorine-containing resin

Examples of a fluorine-containing resin that constitutes the fluorine-containing resin particles include (1) particles of a homopolymer of fluoroolefin, (2) a copolymer of two or more kinds, that is, a copolymer of one or two or more kinds of fluoroolefins and a non-fluorine-based monomer (that is, a monomer that does not have a fluorine atom), and the like.

Examples of fluoroolefins include perfluoroolefins such as tetrafluoroethylene (TFE), perfluorovinyl ether, hexafluoropropylene (HFP), and chlorotrifluoroethylene (CTFE), non-perfluoroolefins such as vinylidene fluoride (VdF), trifluoroethylene, vinyl fluoride. Among these, it is preferable to contain one or more kinds selected from the group consisting of VdF, TFE, CTFE, and HFP as the fluoroolefin.

Examples of the non-fluorine-based monomer include hydrocarbon-based olefins such as ethylene, propylene, and butene; alkyl vinyl ethers such as cyclohexyl vinyl ether (CHVE), ethyl vinyl ether (EVE), butyl vinyl ether, and methyl vinyl ether; alkenyl vinyl ethers such as polyoxyethylene allyl ether (POEAE) and ethyl allyl ether; organosilicon compounds having reactive α, β-unsaturated groups such as vinyltrimethoxysilane (VSi), vinyltriethoxysilane, and vinyltris(methoxyethoxy)silane; acrylic acid esters such as methyl acrylate and ethyl acrylate; methacrylic acid esters such as methyl methacrylate and ethyl methacrylate; vinyl esters such as vinyl acetate, vinyl benzoate, "VeoVa" (trade name, vinyl ester manufactured by Shell Co.); and the like. Among these, it is preferable contain one or more kind selected from the group consisting of alkyl vinyl ether, allyl vinyl ether, vinyl ester, and organosilicon compounds having reactive α, β-unsaturated groups as the non-fluorine-based monomer.

Among these, it is preferable to contain a resin having a high fluorination rate as the fluorine-containing resin, it is more preferable to contain one or more kinds of resins selected from the group consisting of polytetrafluoroethylene (PTFE), tetrafluoroethylene-hexafluoropropylene copolymer (FEP), tetrafluoroethylene-perfluoro(alkyl vinyl ether) copolymer (PFA), ethylene-tetrafluoroethylene copolymer (ETFE), and ethylene-chlorotrifluoroethylene copolymer (ECTFE), and it is still more preferable to contain one or more kinds of resins selected from the group consisting of PTFE, FEP, and PFA.

Method of Forming Particles of Fluorine-Containing Resin

A method of forming particles of the fluorine-containing resin is not particularly limited, and may be an arbitrary method such as a method of forming particles through irradiation with radioactive rays (in this specification, obtained particles are also referred to as "radioactive ray irradiation type fluorine-containing resin particles"), and a method of forming particles by a polymerization method (in this specification, obtained particles are also referred to as "polymerization type fluorine-containing resin particles").

The radioactive ray irradiation type fluorine-containing resin particles (fluorine-containing resin particles obtained through irradiation with radioactive rays) show fluorine-containing resin particles which are granulated in combination with radioactive ray polymerization, and in which the fluorine-containing resin after polymerization is low quantified and atomized due to irradiation with radioactive rays. Since a large amount of carboxylic acids are generated due to irradiation with radioactive rays in the air, the radioactive ray irradiation type fluorine-containing resin particles also contain a large amount of carboxy groups.

The polymerization type fluorine-containing resin particles (fluorine-containing resin particles obtained by the polymerization method) show fluorine-containing resin particles which are granulated in combination with polymerization by a suspension polymerization method, an emulsion polymerization method, or the like, and are not irradiated with radioactive rays. The polymerization type fluorine-containing resin particles are manufactured by polymerization under existence of the basic compound, and thus the basic compound is contained as a residue.

It is preferable that the fluorine-containing resin particles are the polymerization type fluorine-containing resin particles among the above-described particles. The polymerization type fluorine-containing resin particles are fluorine-containing resin particles granulated in combination with polymerization by the suspension polymerization method, the emulsion polymerization method, or the like without being irradiated with radioactive rays.

The manufacturing of the fluorine-containing resin particles by the suspension polymerization method relates to, for example, a method in which additives such as a polymerization initiator and a catalyst are suspended in a dispersion medium in combination with a monomer for forming the fluorine-containing resin, and then the polymer is made into particles while polymerizing the monomer.

Manufacturing of the fluorine-containing resin particles by the emulsion polymerization method relates to, for example, a method in which additives such as a polymerization initiator and a catalyst are emulsified in a dispersion medium in combination with a monomer for forming the fluorine-containing resin by a surfactant (that is, an emulsifier), and then the polymer is made into particles while polymerizing the monomer.

Average Diameter

An average particle size of the fluorine-containing resin particles is not particularly limited, and the average particle size is preferably 0.1 to 4 μm, and more preferably 0.1 to 2 μm. Fluorine-containing resin particles (particularly, PTFE particles or the like) having an average particle size of 0.1 to 4 μm tend to contain a lot of PFOA. According to this, particularly, the fluorine-containing resin particles having an average particle size of 0.1 to 4 μm has a tendency that charging properties deteriorate. However, when suppressing the amount of PFOA within the above-described range, even in the fluorine-containing resin particles having an average particle size of 0.1 to 4 nm, it is considered that the charging properties are enhanced. The average particle size of the fluorine-containing resin particles is a value measured by the above-described method.

Specific Surface Area

From the viewpoint of dispersion stability, a specific surface area (BET specific surface area) of the fluorine-containing resin particles is preferably 5 to 15 $m^2/g$, and more preferably 7 to 13 $m^2/g$. The specific surface area is a value that is measured by a nitrogen substitution method by using a BET type specific surface area measurement device (flow soap II2300, manufactured by Shimadzu Corporation).

Apparent Density

From the viewpoint of dispersion stability, apparent density of the fluorine-containing resin particles is preferably 0.2 to 0.5 g/ml, and more preferably 0.3 to 0.45 g/ml. The apparent density is a value that is measured in conformity to JIS K6891 (1995).

Melting Temperature

A melting temperature of the fluorine-containing resin particles is preferably 300° C. to 340° C., and more preferably 325° C. to 335° C. The melting temperature is a melting point that is measured in conformity to JIS K6891 (1995).

(Fluorine-Containing Dispersant)

A dispersant having fluorine atoms (hereinafter, also referred to as "fluorine-containing dispersant") may be attached to surfaces of the fluorine-containing resin particles. The fluorine-containing dispersant may be used along or in combination of two or more kinds thereof.

Examples of the fluorine-containing dispersant include a polymer obtained by homopolymerizing or copolymerizing a polymerizable compound having a fluorinated alkyl group (hereinafter, also referred to as "fluorinated alkyl group-containing polymer"), a fluorine-based surfactant, and the like, and it is preferable to contain the fluorinated alkyl group-containing polymer.

Specific example of the fluorinated alkyl group-containing polymer include a homopolymer of (meth)acrylate having a fluorinated alkyl group, and a random or block copolymer of (meth)acrylate having a fluorinated alkyl group and a monomer that does not have a fluorine atom, and the like. Not that, in this specification, the (meth)acrylate represents both acrylate and methacrylate.

Examples of the (meth)acrylate having a fluorinated alkyl group include 2,2,2-trifluoroethyl (meth)acrylate, and 2,2,3,3,3-pentafluoropropyl (meth)acrylate.

Examples of the monomer that does not have the fluorine atom include (meth)acrylate, isobutyl (meth)acrylate, t-butyl (meth)acrylate, isooctyl (meth)acrylate, lauryl (meth)acrylate, stearyl (meth)acrylate, isobornyl (meth)acrylate, cyclohexyl (meth)acrylate, 2-methoxyethyl (meth)acrylate, methoxytriethylene glycol (meth)acrylate, 2-ethoxyethyl (meth)acrylate, tetrahydrofurfuryl (meth)acrylate, benzyl (meth)acrylate, ethyl carbitol (meth)acrylate, phenoxyethyl (meth)acrylate, 2-hydroxy (meth)acrylate, 2-hydroxypropyl (meth)acrylate, 4-hydroxybutyl (meth)acrylate, methoxy polyethylene glycol (meth)acrylate, phenoxy polyethylene glycol (meth)acrylate, hydroxyethyl o-phenylphenol (meth) acrylate, o-phenylphenol glycidyl ether (meth)acrylate.

In addition, as a fluorine-containing dispersant other than the above-described dispersants, a block polymer or a branch polymer disclosed in specification of U.S. Pat. No. 5,637,142, Japanese Patent No. 4251662, and the like.

The fluorinated alkyl group-containing polymer preferably contains a fluorinated alkyl group-containing polymer having a structural unit expressed by the following General Formula (FA), and more preferably a fluorinated alkyl group-containing polymer having a structural unit expressed by the following General Formula (FA) and a structural unit expressed by the following General Formula (FB).

Hereinafter, description will be given of a fluorinated alkyl group-containing polymer having the structural unit expressed by the following General Formula (FA) and the structural unit expressed by the following General Formula (FB).

(FA)

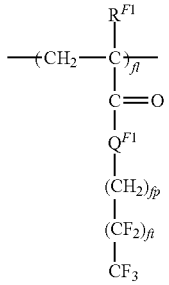

(FB)

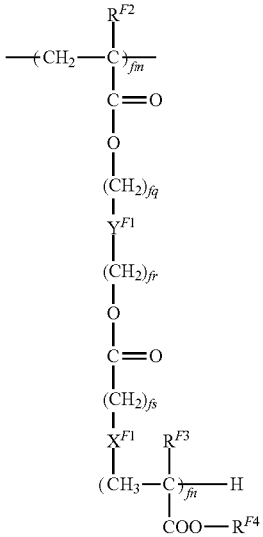

In General Formulae (FA) and (FB), $R^{F1}$, $R^{F2}$, $R^{F3}$, and $R^{F4}$ each independently represent a hydrogen atom or an alkyl group.)

$X^{F1}$ represents an alkylene chain, a halogen-substituted alkylene chain, —S—, —O—, —NH—, or a single bond.

$Y^{F1}$ represents an alkylene chain, a halogen-substituted alkylene chain, —($C_{fx}H_{2fx-1}$(OH))—, or a single bond.

$Q^{F1}$ represents —O— or —NH—.

fl, fm, and fn each independently represent an integer of 1 or greater.

fp, fq, fr, and fs each independently represent 0 or an integer of 1 or greater.

ft represents an integer of 1 to 7.

fx represents an integer of 1 or greater.

In General Formulae (FA) and (FB), as the group representing $R^{F1}$, $R^{F2}$, $R^{F3}$, and $R^{F4}$, a hydrogen atom, a methyl group, an ethyl group, a propyl group, and the like are preferable, the hydrogen atom and the methyl group are more preferable, and the methyl group is still more preferable.

In General Formulae (FA) and (FB), as the alkylene chain (an unsubstituted alkylene chain, a halogen-substituted alkylene chain) representing $X^{F1}$ and $Y^{F1}$, a straight-chain or branched alkylene chain having 1 to 10 carbon atoms is preferable.

fx in —($C_{fx}H_{2fx-1}$(OH))— representing $Y^{F1}$ is preferably an integer of 1 to 10.

fp, fq, fr, and fs are preferably 0 or integers of 1 to 10.

For example, fn is preferably 1 to 60.

In the fluorinated alkyl group-containing polymer having the structural unit expressed by General Formula (FA) and the structural unit expressed by General Formula (FB), a ratio between the structural unit expressed by General Formula (FA) and the structural unit expressed by General Formula (FB), that is, fl:fm is preferably in a range of 1:9 to 9:1, and more preferably in a range of 3:7 to 7:3.

The fluorinated alkyl group-containing polymer may be a polymer polymerized in a state of further containing a structural unit expressed by General Formula (FC) in addition to the structural unit expressed by General Formula (FA) and the structural unit expressed by General Formula (FB). In this case, with regard to a content ratio of the structural unit expressed by General Formula (FC), a ratio (fl+fm:fz) with the sum of the structural units expressed by General Formulae (FA) and (FB), that is, fl+fm is preferably 10:0 to 7:3, and more preferably 9:1 to 7:3.

(FC)

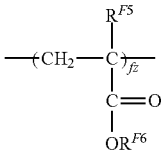

In General Formula (FC), $R^{F5}$ and $R^{F6}$ each independently represent a hydrogen atom or an alkyl group. fz represents an integer of 1 or greater.

In General Formula (FC), in General Formula (FC), as a group representing $R^{F5}$ and $R^{F6}$, a hydrogen atom, a methyl group, an ethyl group, a propyl group, are the like preferable, and the hydrogen atom and the methyl group are more preferable, and the methyl group is still more preferable.

Examples of a commercially available product of the fluorinated alkyl group-containing polymer include GF300, GF400 (manufactured by TOAGOSEI CO., LTD.), SURFLON (registered trademark) series (manufactured by AGC SEIMI CHEMICAL CO., LTD.), Ftergent series (manufactured by Neos Corporation), PF series (manufactured by KITAMURA CHEMICALS CO., LTD.), Megafac (registered trademark) series (manufactured by DIC Corporation), FC series (manufactured by 3M Company), and the like.

Weight-Average Molecular Weight Mw

From the viewpoint of improving dispersibility of the fluorinated alkyl group-containing polymer, a weight-average molecular weight Mw of the fluorinated alkyl group-containing polymer is preferably 20,000 to 200,000, and more preferably 50,000 to 200,000.

The weight-average molecular weight of the fluorinated alkyl group-containing polymer is a value measured by gel permeation chromatography (GPC). For example, measurement of a molecular weight is performed in a chloroform solvent by using GPC, GPC.HLC-8120 manufactured by TOSOH CORPORATION as a measurement device, and column.TSKgel GMHHR-M+TSKgel GMHHR-M (7.8 mm I.D. 30 cm) manufactured by TOSOH CORPORATION is used. From measurement results, the molecular weight is calculated by using a molecular weight calibration curve prepared by a monodispersion polystyrene standard sample.

Content

For example, the amount of the fluorine-containing dispersant that is contained is preferably 0.5% by mass to 10% by mass with respect to fluorine-containing resin particles, and more preferably 1% by mass to 7% by mass.

Method of Attaching Fluorine-Containing Dispersant to Surface

A method of attaching the fluorine-containing dispersant to a surface of the fluorine-containing resin particles is not particularly limited. Examples of the method of attaching the fluorine-containing dispersant to the surface of the fluorine-containing resin particles includes the following (1) to (3).

(1) A method of preparing a dispersion solution of the fluorine-containing resin particles by mixing the fluorine-containing resin particles, the fluorine-containing dispersant, and a dispersion solvent.

(2) A method of mixing the fluorine-containing resin particles and the fluorine-containing dispersant by using a dry powder mixer to attach the fluorine-containing dispersant to the fluorine-containing resin particles.

(3) A method in which the fluorine-containing dispersant dissolved in a solvent is added dropwise while stirring the fluorine-containing resin particles, and the solvent is removed.

<<Charge Transportation Layer>>

The charge transportation layer is a layer containing, for example, a charge transportation material and a binding resin. The charge transportation layer may be a layer containing a polymer charge transportation material.

Examples of the charge transportation material include electron transporting compounds such as quinone compounds such as p-benzoquinone, chloranil, bromanyl, and anthraquinone; tetracyanoquinodimethane-based compounds; fluorenone compounds such as 2,4,7-trinitrofluorenone; xanthone-based compounds; benzophenone-based compounds; cyanovinyl-based compounds; and ethylene-based compounds. Examples of the charge transportation material also include hole transporting compounds such as triarylamine-based compounds, benzidine-based compounds, arylalkane-based compounds, aryl-substituted ethylene-based compounds, stilbene-based compounds, anthracene-based compounds, and hydrazine-based compounds. The charge transportation materials may be used alone or in combination of two or more kinds, but there is no limitation thereto.

Among these compounds, from the viewpoint of charge mobility, the triarylamine-based compounds and benzidine-based compounds are a preferable charge transportation material. Among these, as the triarylamine-based compounds, a charge transportation material (hereinafter, also referred to as "butadiene-based charge transportation material") expressed by the following Formula (CT1) as an example of the triarylamine-based compound is preferable. In addition, as the benzidine-based compounds, a charge transportation material (hereinafter, also referred to as "benzidine-based charge transportation material") expressed by the following General Formula (CT2) is preferable.

Butadiene-Based Charge Transportation Material

Hereinafter, description will be given of the butadiene-based charge transportation material. The butadiene-based charge transportation material is expressed by the following General Formula (CT1).

(CT1)

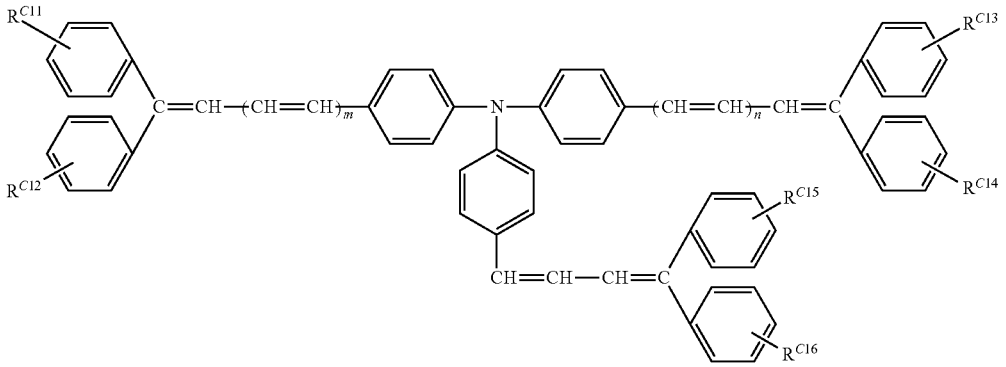

In General Formula (CT1), $R^{C11}$, $R^{C12}$, $R^{C13}$, $R^{C14}$, $R^{C15}$, and $R^{C16}$ each independently represent a hydrogen atom, a halogen atom, an alkyl group having 1 to 20 carbon atoms, an alkoxy group having 1 to 20 carbon atoms, or an aryl group having 6 to 30 carbon atoms, and two adjacent substituents may be bonded to each other to form a hydrocarbon ring structure. n and m each independently represent 0, 1, or 2.

In General Formula (CT1), examples of the halogen atom represented by $R^{C11}$, $R^{C12}$, $R^{C13}$, $R^{C14}$, $R^{C15}$, and $R^{C16}$ include a fluorine atom, a chlorine atom, a bromine atom, and iodine atom, and the like. Among these, as the halogen atom, the fluorine atom and the chlorine atom are preferable, and the chlorine atom is more preferable.

In General Formula (CT1), examples of the alkyl group represented by $R^{C11}$, $R^{C12}$, $R^{C13}$, $R^{C14}$, $R^{C15}$, and $R^{C16}$ include a straight-chain or branched alkyl group having 1 to 20 carbon atoms (preferably, 1 to 6 carbon atoms, and more preferably 1 to 4 carbon atoms).

Specific examples of the straight-chain alkyl group include a methyl group, an ethyl group, an n-propyl group, an n-butyl group, an n-pentyl group, an n-hexyl group, an n-heptyl group, an n-octyl group, an n-nonyl group, an n-decyl group, an n-undecyl group, an n-dodecyl group, an n-tridecyl group, an n-tetradecyl group, an n-pentadecyl group, an n-hexadecyl group, an n-heptadecyl group, an n-octadecyl group, an n-nonadecyl group, and an n-icosyl group.

Specific examples of the branched alkyl group include an isopropyl group, an isobutyl group, a sec-butyl group, a tert-butyl group, an isopentyl group, a neopentyl group, a tert-pentyl group, an isohexyl group, a sec-hexyl group, a tert-hexyl group, an isoheptyl group, a sec-heptyl group, a tert-heptyl group, an isooctyl group, a sec-octyl group, a tert-octyl group, an isononyl group, a sec-nonyl group, a tert-nonyl group, an isodecyl group, a sec-decyl group, a tert-decyl group, an isoundecyl group, a sec-undecyl group, a tert-undecyl group, a neoundecyl group, an isododecyl group, a sec-dodecyl group, a tert-dodecyl group, a neododecyl group, an isotridecyl group, a sec-tridecyl group, a tert-tridecyl group, a neotridecyl group, an isotetradecyl group, a sec-tetradecyl group, a tert-tetradecyl group, a neotetradecyl group, a 1-isobutyl-4-ethyloctyl group, an isopentadecyl group, a sec-pentadecyl group, a tert-pentadecyl group, a neopentadecyl group, an isohexadecyl group, a sec-hexadecyl group, a tert-hexadecyl group, a neohexadecyl group, a 1-methylpentadecyl group, an isoheptadecyl group, a sec-heptadecyl group, a tert-heptadecyl group, a neoheptadecyl group, an isooctadecyl group, a sec-octadecyl group, a tert-octadecyl group, a neooctadecyl group, an isononadecyl group, a sec-nonadecyl group, a tert-nonadecyl group, a neononadecyl group, a 1-methyloctyl group, an isoicosyl group, a sec-icosyl group, a tert-icosyl group, a neoicosyl group, and the like.

Among these, as the alkyl group, a lower alkyl group such as the methyl group, the ethyl group, and the isopropyl group is preferable.

In General Formula (CT1), Examples of the alkoxy group represented by $R^{C11}$, $R^{C12}$, $R^{C13}$, $R^{C14}$, $R^{C15}$, and $R^{C16}$ include a straight-chain or branched alkoxy group having 1 to 20 carbon atoms (preferably, 1 to 6 carbon atoms, and more preferably 1 to 4 carbon atoms).

Specific examples of the straight-chain alkoxy group include a methoxy group, an ethoxy group, an n-propoxy group, an n-butoxy group, an n-pentyloxy group, an n-hexyloxy group, an n-heptyloxy group, an n-octyloxy group, an n-nonyloxy group, an n-decyloxy group, an n-undecyloxy group, an n-dodecyloxy group, an n-tridecyloxy group, an n-tetradecyloxy group, an n-pentadecyloxy group, an n-hexadecyl oxy group, an n-heptadecyloxy group, an n-octadecyloxy group, an n-nonadecyloxy group, an n-icosyloxy group, and the like.

Specific examples of the branched alkoxy group include an isopropoxy group, an isobutoxy group, a sec-butoxy group, a tert-butoxy group, an isopentyloxy group, a neopentyloxy group, a tert-pentyloxy group, an isohexyloxy group, a sec-hexyloxy group, a tert-hexyloxy group, an isoheptyloxy group, a sec-heptyloxy group, a tert-heptyloxy group, an isooctyloxy group, a sec-octyloxy group, a tert-octyloxy group, an isononyloxy group, a sec-nonyloxy group, a tert-nonyloxy group, an isodecyloxy group, a sec-decyloxy group, a tert-decyloxy group, an isoundecyloxy group, a sec-undecyloxy group, a tert-undecyloxy group, a neoundecyloxy group, an isododecyloxy group, a sec-dodecyloxy group, a tert-dodecyloxy group, a neododecyloxy group, an isotridecyloxy group, a sec-tridecyloxy group, a tert-tridecyloxy group, a neotridecyloxy group, an isotetradecyloxy group, a sec-tetradecyloxy group, a tert-tetradecyloxy group, a neotetradecyloxy group, a 1-isobutyl-4-ethyloctyloxy group, an isopentadecyloxy group, a sec-pentadecyloxy group, a tert-pentadecyloxy group, a neopentadecyloxy group, an isohexadecyloxy group, sec-hexadecyloxy group, tert-hexadecyloxy group, a neohexadecyloxy group, a 1-methylpentadecyloxy group, an isoheptadecyloxy group, a sec-heptadecyloxy group, a tert-heptadecyloxy group, a neoheptadecyloxy group, an isooctadecyloxy group, a sec-octadecyloxy group, a tert-octadecyloxy group, a neooctadecyloxy group, an isononadecyloxy group, a sec-nonadecyloxy group, a tert-nonadecyloxy group, a neononadecyloxy group, a 1-methyloctyloxy group, an isoicosyloxy group, a sec-icosyloxy group, a tert-icosyloxy group, a neoicosyloxy group, and the like.

Among these, the methoxy group is preferable as the alkoxy group.

In General Formula (CT1), examples of the aryl group represented by $R^{C11}$, $R^{C12}$, $R^{C13}$, $R^{C14}$, $R^{C15}$, and $R^{C16}$ include an aryl group having 6 to 30 carbon atoms (preferably, 6 to 20 carbon atoms, and more preferably 6 to 16 carbon atoms).

Specific examples of the aryl group include a phenyl group, a naphthyl group, a phenanthryl group, a biphenylyl group, and the like.

Among these, the phenyl group and the naphthyl group are preferable as the aryl group.

Note that, in General Formula (CT1), each substituent represented by $R^{C11}$, $R^{C12}$, $R^{C13}$, $R^{C14}$, $R^{C15}$, and $R^{C16}$ further includes a group having a substituent. Examples of the substituent include the above-described atoms and groups (for example, the halogen atom, the alkyl group, the alkoxy group, the aryl group, and the like).

In General Formula (CT1), in a hydrocarbon ring structure in which adjacent two substituents (for example, $R^{C11}$ and $R^{C12}$, $R^{C13}$ and $R^{C14}$, and $R^{C15}$ and $R^{C16}$) of $R^{C11}$, $R^{C12}$, $R^{C13}$, $R^{C14}$, $R^{C15}$, and $R^{C16}$ are linked, examples of a group linking the substituents include a single bond, a 2,2'-methylene group, a 2,2'-ethylene group, a 2,2'-vinylene group, and the like. Among these, the single bond and the 2,2'-methylene group are preferable.

Here, specific examples of the hydrocarbon ring structure include a cycloalkane structure, a cycloalkene structure, a cycloalkane polyene structure, and the like.

In General Formula (CT1), n and m are preferably 1.

In General Formula (CT1), from the viewpoint of forming a photosensitive layer (charge transportation layer) with high charge transportability, it is preferable that $R^{C11}$, $R^{C12}$, $R^{C13}$, $R^{C14}$, $R^{C15}$, and $R^{C16}$ represent a hydrogen atom, an alkyl group having 1 to 20 carbon atoms, or an alkoxy group having 1 to 20 carbon atoms, m and n represent 1 or 2, and it is more preferable that $R^{C11}$, $R^{C12}$, $R^{C13}$, $R^{C14}$, $R^{C15}$, and $R^{C16}$ represent the hydrogen atom, and m and n represent 1.

That is, it is more preferable that the butadiene-based charge transportation material (CT1) is a charge transfer material (exemplified compound (CT1-3)) expressed by the following Structural Formula (CT1A).

compound number is noted as an exemplified compound (CT1-number). Specifically, for example, an exemplified compound 15 is noted as "exemplified compound (CT1-15)".

| No. | m | n | $R^{C11}$ | $R^{C2}$ | $R^{C13}$ | $RC^{14}$ | $RC^{15}$ | $RC^{16}$ |
|---|---|---|---|---|---|---|---|---|
| CT1-1 | 1 | 1 | 4-$CH_3$ | 4-$CH_3$ | 4-$CH_3$ | 4-$CH_3$ | H | H |
| CT1-2 | 2 | 2 | H | H | H | H | 4-$CH_3$ | 4-$CH_3$ |
| CT1-3 | 1 | 1 | H | H | H | H | H | H |
| CT1-4 | 2 | 2 | H | H | H | H | H | H |
| CT1-5 | 1 | 1 | 4-$CH_3$ | 4-$CH_3$ | 4-$CH_3$ | H | H | H |
| CT1-6 | 0 | 1 | H | H | H | H | H | H |
| CT1-7 | 0 | 1 | 4-$CH_3$ | 4-$CH_3$ | 4-$CH_3$ | 4-$CH_3$ | 4-$CH_3$ | 4-$CH_3$ |
| CT1-8 | 0 | 1 | 4-$CH_3$ | 4-$CH_3$ | H | H | 4-$CH_3$ | 4-$CH_3$ |
| CT1-9 | 0 | 1 | H | H | 4-$CH_3$ | 4-$CH_3$ | H | H |
| CT1-10 | 0 | 1 | H | H | 4-$CH_3$ | 4-$CH_3$ | H | H |
| CT1-11 | 0 | 1 | 4-$CH_3$ | H | H | H | 4-$CH_3$ | H |
| CT1-12 | 0 | 1 | 4-$OCH_3$ | H | H | H | 4-$OCH_3$ | H |
| CT1-13 | 0 | 1 | H | H | 4-$OCH_3$ | 4-$OCH_3$ | H | H |
| CT1-14 | 0 | 1 | 4-$OCH_3$ | H | 4-$OCH_3$ | H | 4-$OCH_3$ | 4-$OCH_3$ |
| CT1-15 | 0 | 1 | 3-$CH_3$ | H | 3-$CH_3$ | H | 3-$CH_3$ | H |
| CT1-16 | 1 | 1 | 4-$CH_3$ | 4-$CH_3$ | 4-$CH_3$ | 4-$CH_3$ | 4-$CH_3$ | 4-$CH_3$ |
| CT1-17 | 1 | 1 | 4-$CH_3$ | 4-$CH_3$ | H | H | 4-$CH_3$ | 4-$CH_3$ |
| CT1-18 | 1 | 1 | H | H | 4-$CH_3$ | 4-$CH_3$ | H | H |
| CT1-19 | 1 | 1 | H | H | 3-$CH_3$ | 3-$CH_3$ | H | H |
| CT1-20 | 1 | 1 | 4-$CH_3$ | H | H | H | 4-$CH_3$ | H |
| CT1-21 | 1 | 1 | 4-$OCH_3$ | H | H | H | 4-$OCH_3$ | H |
| CT1-22 | 1 | 1 | H | H | 4-$OCH_3$ | 4-$OCH_3$ | H | H |
| CT1-23 | 1 | 1 | 4-$OCH_3$ | H | 4-$OCH_3$ | H | 4-$OCH_3$ | 4-$OCH_3$ |
| CT1-24 | 1 | 1 | 3-$CH_3$ | H | 3-$CH_3$ | H | 3-$CH_3$ | H |

Note that, abbreviations in the exemplified compounds have the following meanings. In addition, a number given before a substituent represents a substitution position with respect to a benzene ring.

—$CH_3$: a methyl group

—$OCH_3$: a methoxy group

The butadiene-based charge transportation material (CT1) may be used alone, or in combination of two or more kinds thereof Benzidine-Based Charge Transportation Material As the benzidine-based compound, from the viewpoint of charge mobility, a benzidine-based charge transportation material (CT2) expressed by the following General Formula (CT2) is preferable.

Particularly, from the viewpoint of the charge mobility, as the charge transportation material, it is preferable to use the butadiene-based charge transportation material (CT1) and (CT1A)

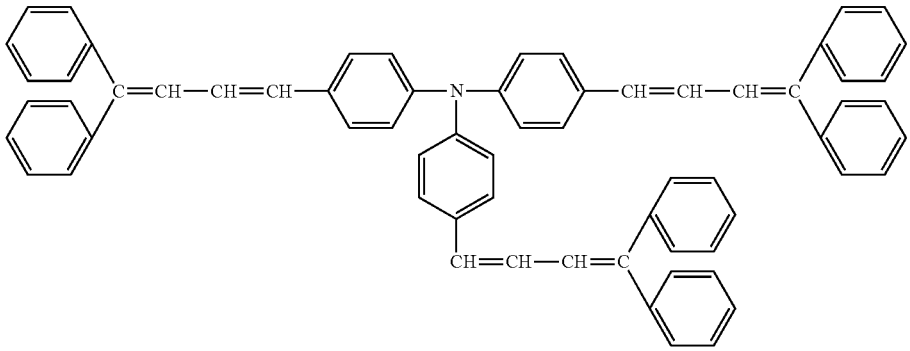

Specific examples of the butadiene-based charge transportation material (CT1) will be described below, but there is no limitation thereto. Note that, the following exemplified the benzidine-based charge transportation material (CT2) in combination. Note that, in a case where the butadiene-based charge transportation material (CT1) and benzidine-based charge transportation material (CT2) are used in combination, a mass ratio (the amount of the butadiene-based charge transportation material (CT1) contained/the amount of the benzidine-based charge transportation material (CT2) contained) is preferably 1/9 to 5/5, and more preferably 1/9 to 4/6 from the viewpoint of charge transportability.

Hereinafter, description will be given of the benzidine-based charge transportation material. The benzidine-based charge transportation material is expressed by the following General Formula (CT2).

(CT2)

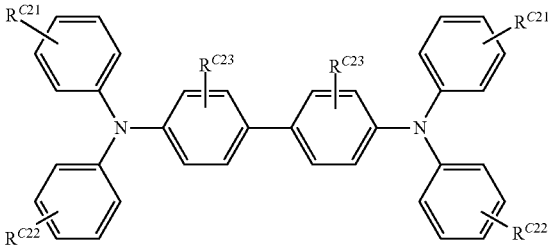

In General Formula (CT2), $R^{C21}$, $R^{C22}$, and $R^{C23}$ each independently represent a hydrogen atom, a halogen atom, a hydroxyl group, a formyl group, an alkyl group, an alkoxy group, or an aryl group.

In General Formula (CT2), examples of the halogen atom represented by $R^{C21}$, $R^{C22}$, and $R^{C23}$ include a fluorine atom, a chlorine atom, a bromine atom, an iodine atom, and the like. Among these, as the halogen atom, the fluorine atom and the chlorine atom are preferable, and the chlorine atom is more preferable.

In General Formula (CT2), examples of the alkyl group represented by $R^{C21}$, $R^{C22}$, and $R^{C23}$ include a straight-chain or branched alkyl group having 1 to 10 carbon atoms (preferably, 1 to 6 carbon atoms, and more preferably 1 to 4 carbon atoms).

Specific examples of the straight-chain alkyl group include a methyl group, an ethyl group, an n-propyl group, an n-butyl group, an n-pentyl group, an n-hexyl group, an n-heptyl group, an n-octyl group, an n-nonyl group, an n-decyl group, and the like.

Specific examples of the branched alkyl group include an isopropyl group, an isobutyl group, a sec-butyl group, a tert-butyl group, an isopentyl group, a neopentyl group, a tert-pentyl group, an isohexyl group, a sec-hexyl group, a tert-hexyl group, an isoheptyl group, a sec-heptyl group, a tert-heptyl group, an isooctyl group, a sec-octyl group, a tert-octyl group, an isononyl group, a sec-nonyl group, a tert-nonyl group, an isodecyl group, a sec-decyl group, a tert-decyl group, and the like.

Among these, as the alkyl group, a lower alkyl group such as the methyl group, the ethyl group, and the isopropyl group are preferable.

In General Formula (CT2), examples of the alkoxy group represented by $R^{C21}$, $R^{C22}$, and $R^{C23}$ include a straight-chain or branched alkoxy group having 1 to 10 carbon atoms (preferably, 1 to 6 carbon atoms, and more preferably 1 to 4 carbon atoms).

Specific examples of the straight-chain alkoxy group include a methoxy group, an ethoxy group, an n-propoxy group, an n-butoxy group, an n-pentyloxy group, an n-hexyloxy group, an n-heptyloxy group, an n-octyloxy group, an n-nonyloxy group, an n-decyloxy group, and the like.

Specific examples of the branched alkoxy group include an isopropoxy group, an isobutoxy group, a sec-butoxy group, a tert-butoxy group, an isopentyloxy group, a neopentyloxy group, a tert-pentyloxy group, an isohexyloxy group, a sec-hexyloxy group, a tert-hexyloxy group, an isoheptyloxy group, a sec-heptyloxy group, a tert-heptyloxy group, an isooctyloxy group, a sec-octyloxy group, a tert-octyloxy group, an isononyloxy group, a sec-nonyloxy group, a tert-nonyloxy group, an isodecyloxy group, a sec-decyloxy group, a tert-decyloxy group, and the like.

Among these, as the alkoxy group, the methoxy group is preferable.

In General Formula (CT2), examples of the aryl group represented by $R^{C21}$, $R^{C22}$, and $R^{C23}$ includes an aryl group having 6 to 10 carbon atoms (preferably, 6 to 9 carbon atoms, and more preferably 6 to 8 carbon atoms). Specific examples of the aryl group include a phenyl group, a naphthyl group, and the like. Among these, as the aryl group, the phenyl group is preferable.

Note that, in General Formula (CT2), each substituent represented by $R^{C21}$, $R^{C22}$, and $R^{C23}$ further includes a group having a substituent. Examples of the substituent include the above-described atoms and groups (for example, the halogen atom, the alkyl group, the alkoxy group, the aryl group, and the like).

In General Formula (CT2), particularly, from the viewpoint of forming a photosensitive layer (charge transportation layer) with high charge transportability, it is preferable that $R^{C21}$, $R^{C22}$, and $R^{C23}$ each independently represent a hydrogen atom, and an alkyl group having 1 to 10 carbon atoms, and it is more preferable that $R^{C21}$, $R^{C22}$, and $R^{C23}$ represent the hydrogen atom, and $R^{C22}$ represents an alkyl group having 1 to 10 carbon atoms (particularly, a methyl group).

Specifically, it is particularly preferable that the benzidine-based charge transportation material (CT2) is a charge transportation material (exemplified compound (CT 2-2)) expressed by the following Structural Formula (CT2A).

(CT2A)

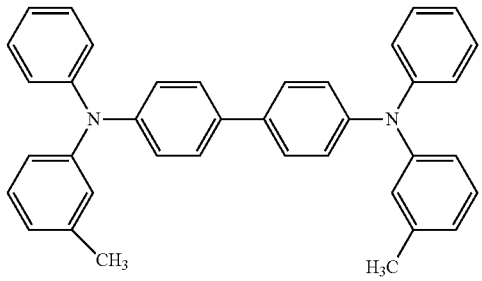

Specific examples of the charge transportation material expressed by General Formula (CT2) will be described below, but there is no limitation thereto. Note that, the following exemplified compound number is noted as an exemplified compound (CT2-number). Specifically, an exemplified compound 15 is noted as "exemplified compound (CT2-15)".

| No | $R^{C21}$ | $R^{C22}$ | $R^{C23}$ |
|---|---|---|---|
| CT2-1 | H | H | H |
| CT2-2 | H | 3-$CH_3$ | H |

-continued

| No | $R^{C21}$ | $R^{C22}$ | $R^{C23}$ |
|---|---|---|---|
| CT2-3 | H | 4-$CH_3$ | H |
| CT2-4 | H | 3-$C_2H_5$ | H |
| CT2-5 | H | 4-$C_2H_5$ | H |
| CT2-6 | H | 3-$OCH_3$ | H |
| CT2-7 | H | 4-$OCH_3$ | H |
| CT2-8 | H | 3-$OC_2H_5$ | H |
| CT2-9 | H | 4-$OC_2H_5$ | H |
| CT2-10 | 3-$CH_3$ | 3-$CH_3$ | H |
| CT2-11 | 4-$CH_3$ | 4-$CH_3$ | H |
| CT2-12 | 3-$C_2H_5$ | 3-$C_2H_5$ | H |
| CT2-13 | 4-$C_2H_5$ | 4-$C_2H_5$ | H |
| CT2-14 | H | H | 2-$CH_3$ |
| CT2-15 | H | H | 3-$CH_3$ |
| CT2-16 | H | 3-$CH_3$ | 2-$CH_3$ |
| CT2-17 | H | 3-$CH_3$ | 3-$CH_3$ |
| CT2-18 | H | 4-$CH_3$ | 2-$CH_3$ |
| CT2-19 | H | 4-$CH_3$ | 3-$CH_3$ |
| CT2-20 | 3-$CH_3$ | 3-$CH_3$ | 2-$CH_3$ |
| CT2-21 | 3-$CH_3$ | 3-$CH_3$ | 3-$CH_3$ |
| CT2-22 | 4-$CH_3$ | 4-$CH_3$ | 2-$CH_3$ |
| CT2-23 | 4-$CH_3$ | 4-$CH_3$ | 3-$CH_3$ |

Note that, abbreviations in the exemplified compounds have the following meanings. In addition, a number given before a substituent represents a substitution position with respect to a benzene ring.

—$CH_3$: a methyl group

—$C_2H_5$: an ethyl group

—$OCH_3$: a methoxy group

—$OC_2H_5$: an ethoxy group

The benzidine-based charge transportation material (CT2) may be used alone, or in combination of two or more kinds thereof.

As the polymer charge transporting material, known materials having a charge transporting property such as poly-N-vinylcarbazole and polysilane are used. Particularly, polyester-based polymer charge transportation materials disclosed in JP-A-8-176293, JP-A-8-208820, and the like are particularly preferable. The polymer charge transportation material may be used alone or in combination with a binder resin.

Examples of the binding resin that is used in the charge transportation layer include a polycarbonate resin, a polyester resin, a polyarylate resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone alkyd resin, a phenol-formaldehyde resin, a styrene-alkyd resin, poly-N-vinylcarbazole, polysilane, and the like. Among these, the polycarbonate resin or the polyarylate resin is preferable as the binding resin. These binder resins are used alone or in combination of two or more kinds.

A mixing ratio between the charge transportation material and the binding resin is preferably 10:1 to 1:5 in terms of mass ratio.

When the fluorine-containing resin particles having a lot of carboxyl groups are applied in combination with the polycarbonate resin, the dispersibility of the fluorine-containing resin particles tends to decrease. Particularly, when applying a polycarbonate resin including a structural unit expressed by the following General Formula (PCA) and a structural unit expressed by the following General Formula (PCB) in which the number of carbonate groups (—OC(═O)O—) per unit mole increases, the dispersibility of the fluorine-containing resin particles tends to decrease. According to this, in the case of applying the polycarbonate resin including a structural unit expressed by the following General Formula (PCA) and a structural unit expressed by the following General Formula (PCB), it is preferable to apply fluorine-containing resin particles in which the number of carboxyl groups is 0 to 30 per $10^6$ carbon atoms.

(PCA)

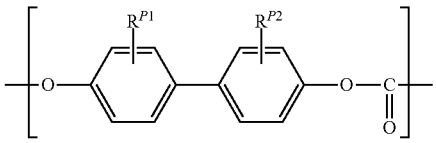

(PCB)

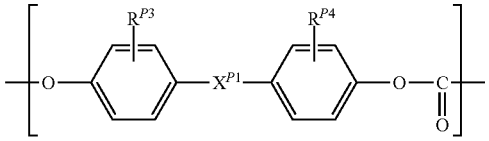

In General Formulae (PCA) and (PCB), $R^{P1}$, $R^{P2}$, $R^{P3}$, and $R^{P4}$ each independently represent a hydrogen atom, a halogen atom, an alkyl group having 1 to 6 carbon atoms, an cycloalkyl group having 5 to 7 carbon atoms, and an aryl group having 6 to 12 carbon atoms. $X^{P1}$ represents a phenylene group, a biphenylylene group, a naphthylene group, an alkylene group, or a cycloalkylene group.

In General Formulae (PCA) and (PCB), examples of the alkyl group represented by $R^{P1}$, $R^{P2}$, $R^{P3}$, and $R^{P4}$ include a straight-chain or branched alkyl group having 1 to 6 carbon atoms (preferably, 1 to 3 carbon atoms).

Specific examples of the straight-chain alkyl group include a methyl group, an ethyl group, an n-propyl group, an n-butyl group, an n-pentyl group, an n-hexyl group, and the like.

Specific examples of the branched alkyl group include an isopropyl group, an isobutyl group, a sec-butyl group, a tert-butyl group, an isopentyl group, a neopentyl group, a tert-pentyl group, an isohexyl group, a sec-hexyl group, a tert-hexyl group, and the like.

Among these, as the alkyl group, a lower alkyl group such as the methyl group and the ethyl group are preferable.

In General Formulae (PCA) and (PCB), examples of the cycloalkyl group represented by $R^{P1}$, $R^{P2}$, $R^{P3}$, and $R^{P4}$ include a cyclopentyl group, a cyclohexyl group, and a cycloheptyl group.

In General Formulae (PCA) and (PCB), examples of the aryl group represented by $R^{P1}$, $R^{P2}$, $R^{P3}$, and $R^{P4}$ include a phenyl group, a naphthyl group, a biphenylyl group, and the like.

In General Formulae (PCA) and (PCB), examples of the alkylene group represented by $X^{P1}$ include a straight-chain or branched alkylene group having 1 to 12 carbon atoms (preferably, 1 to 6 carbon atoms, and more preferably 1 to 3 carbon atoms).

Specific examples of the straight-chain alkylene group include a methylene group, an ethylene group, an n-propylene group, an n-butylene group, an n-pentylene group, an n-hexylene group, an n-heptylene group, an n-octylene group, an n-nonylene group, an n-decylene group, an n-undecylene group, an n-dodecylene group, and the like.

Specific examples of the branched alkylene group include an isopropylene group, an isobutylene group, a sec-butylene group, a tert-butylene group, an isopentylene group, a neopentylene group, a tert-pentylene group, an isohexylene group, a sec-hexylene group, a tert-hexylene group, an isoheptylene group, a sec-heptylene group, a tert-heptylene group, an isooctylene group, a sec-octylene group, a tert-octylene group, an isononylene group, a sec-nonylene group, a tert-nonylene group, an isodecylene group, a sec-decylene group, a tert-decylene group, an isoundecylene group, a sec-undecylene group, a tert-undecylene group, a neoundecylene group, an isododecylene group, a sec-dodecylene group, a tert-dodecylene group, a neododecylene group, and the like.

Among these, as the alkylene group, lower alkyl groups such as the methylene group, the ethylene group, and the butylene group are preferable.

In General Formulae (PCA) and (PCB), examples of the cycloalkylene group represented by $X^{P1}$ include a cycloalkylene group having 3 to 12 carbon atoms (preferably, 3 to 10 carbon atoms, and more preferably 5 to 8 carbon atoms).

Specific examples of the cycloalkylene group include a cyclopropylene group, a cyclopentylene group, a cyclohexylene group, a cyclooctylene group, a cyclododecanylene group, and the like.

Among these, as the cycloalkylene group, the cyclohexylene group is preferable.

Note that, in General Formulae (PCA) and (PCB), each substituent represented by $R^{P1}$, $R^{P2}$, $R^{P3}$, $R^{P4}$, and $X^{P1}$ further includes a group having a substituent. Examples of the substituent include a halogen atom (for example, a fluorine atom and a chlorine atom), an alkyl group (for example, an alkyl group having 1 to 6 carbon atoms), a cycloalkyl group (for example, a cycloalkyl group having 5 to 7 carbon atoms), an alkoxy group (for example, an alkoxy group having 1 to 4 carbon atoms), an aryl group (for example, a phenyl group, a naphthyl group, a biphenylyl group, and the like), and the like.

In General Formula (PCA), it is preferable that $R^{P1}$ and $R^{P2}$ each independently represent a hydrogen atom or an alkyl group having 1 to 6 carbon atoms, and it is more preferable that $R^{P1}$ and $R^{P2}$ represent the hydrogen atom.

In General Formula (PCB), it is preferable that $R^{P3}$ and $R^{P4}$ each independently represent a hydrogen atom or an alkyl group having 1 to 6 carbon atoms, and $X^{P1}$ represents an alkylene group or a cycloalkylene group.

As specific examples of a BP polycarbonate resin, the following resins may be exemplified, but there is no limitation thereto. Note that, in exemplified compounds, pm and pn represent copolymerization ratios.

(PC-1)

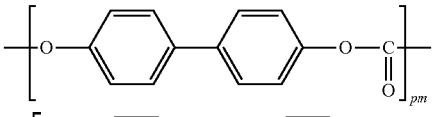

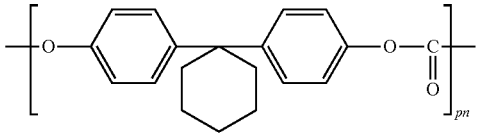

(PC-2)

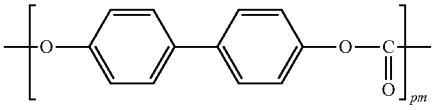

-continued

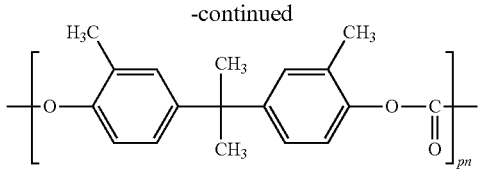

(PC-3)

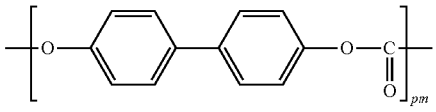

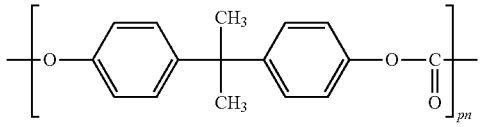

Here, in a P polycarbonate resin, a content ratio (copolymerization ratio) of a structural unit expressed by General Formula (PCA) may be within a range of 5 to 95 mol % with respect to all structural units constituting the polycarbonate resin, and from the viewpoint of suppressing density unevenness of an granular image, the content ratio is preferably 5 to 50 mol %, and still more preferably 15 to 30 mol %.

Specifically, among the exemplified compounds of the BP polycarbonate resin, pm and pn represent a copolymerization ratio (molar ratio), and it is preferable that pm:pn is in a range of 95:5 to 5:95, more preferably a range of 50:50 to 5:95, and still more preferably 15:85 to 30:70.

Note that, a mixing ratio of the charge transportation material and the binding resin is preferably in a range of 10:1 to 1:5 in terms of mass ratio.

Other known additives may be contained in the charge transportation layer.

Formation of the charge transportation layer is not particularly limited, and a known formation method is used. For example, the formation is performed as follows. A coated film of a charge transportation layer forming application solution obtained by adding the above-described components to a solvent is formed, and the coated film is dried and is heated as necessary.

Examples of the solvent for preparing the charge transportation layer forming application solution include aromatic hydrocarbons such as benzene, toluene, xylene, and chlorobenzene; ketones such as acetone and 2-butanone; halogenated aliphatic hydrocarbons such as methylene chloride, chloroform, and ethylene chloride; typical organic solvents such as cyclic or straight-chain ethers such as tetrahydrofuran and ethyl ether. These solvents are used alone, or two or more kinds thereof are mixed and used.

Examples of an application method for applying the charge transportation layer forming application solution onto the charge generation layer include typical methods such as a blade coating method, a wire bar coating method, a spray coating method, a dip coating method, a bead coating method, an air knife coating method, and a curtain coating method.

For example, the film thickness of the charge transportation layer is preferably set in a range of 5 to 50 μm, and more preferably in a range of 10 to 30 μm.

<<Surface Protective Layer>>

The surface protective layer is provided on the photosensitive layer as necessary.

For example, the surface protective layer is provided to prevent chemical change of the photosensitive layer when being charged, or to further improve mechanical strength of the photosensitive layer. Accordingly, a layer constituted by a cured film (crosslinked film) may be applicable to the surface protective layer.

Examples of the surface protective layer constituted by the cured film include layers shown in the following (1) or (2)

(1) A layer constituted by a cured film of a composition containing a reactive group-containing charge transportation material that has a reactive group and a charge transporting skeleton in the same molecule (that is, a layer containing a polymer or a crosslinked body of the reactive group-containing charge transportation material).

(2) A layer constituted by a cured film of a composition containing a non-reactive charge transportation material, and a reactive group-containing non-charge transportation material that does not have a charge-transporting skeleton and has a reactive group (that is, a layer containing non-reactive charge transportation material and a polymer or crosslinked body of the reactive group-containing non-charge transportation material).

Examples of the reactive group of the reactive group-containing charge transportation material include known reactive groups such as a chain-polymerizable group, an epoxy group, —OH, —OR [provided that, R represents an alkyl group], —$NH_2$, —SH, —COOH, and —$SiR^{Q1}{}_{3-Qn}(OR^{Q2})_{Qn}$ [provided that, $R^{Q1}$ represents a hydrogen atom, an alkyl group, or a substituted or unsubstituted aryl group, and $R^{Q2}$ represents a hydrogen atom, an alkyl group, or a trialkylsilyl group. Qn represents an integer of 1 to 3].

The chain-polymerizable group is not particularly limited as long as the chain-polymerizable group is a radically polymerizable functional group, and is, for example, a functional group having a group having at least a carbon double bond. Specific examples thereof include a group containing at least one selected from a vinyl group, a vinyl ether group, a vinyl thioether group, a styryl group (vinyl phenyl group), an acryloyl group, a methacryloyl group, and derivatives thereof, and the like. The chain-polymerizable group is preferably a group containing at least one selected from the vinyl group, the styryl group (vinylphenyl group), the acryloyl group, the methacryloyl group, and derivatives thereof among the groups from the viewpoint that reactivity is excellent.

The charge-transporting skeleton of the reactive group-containing charge-transportation material is not particularly limited as long as the charge-transporting skeleton has a known structure in the electrophotographic photoreceptor, and examples thereof include a structure that is a skeleton derived from a nitrogen-containing hole transporting compound such as a triarylamine-based compound, a benzidine-based compound, and a hydrazone-based compound, and is conjugated with a nitrogen atom. Among these, the triarylamine skeleton is preferable.

The reactive group-containing charge transportation material having the reactive group and the charge transporting skeleton, the non-reactive charge transportation material, and the reactive group-containing non-charge transportation material may be selected from known materials.

Other known additives may be contained in the surface protective layer.

Formation of the surface protective layer is not particularly limited, and a known formation method is used. For example, the formation is performed as follows. A coated film of a surface protective layer forming application solution obtained by adding the above-described compounds to a solvent is formed, and the coated film is dried, and is subjected to a curing treatment such as heating as necessary.

Examples of the solvent for preparing the surface protective layer forming application solution include an aromatic solvent such as toluene and xylene; a ketone-based solvent such as methyl ethyl ketone, methyl isobutyl ketone, and cyclohexanone; an ester-based solvent such as ethyl acetate and butyl acetate; an ether-based solvent such as tetrahydrofuran and dioxane; a cellosolve solvent such as ethylene glycol monomethyl ether; an alcohol solvent such as isopropyl alcohol and butanol. These solvents are used alone or two or more kinds thereof are mixed and used.

Note that, the surface protective layer forming application solution may be a solvent-free application solution.

Examples of a method of applying the surface protective layer forming application solution onto the photosensitive layer (for example, the charge transportation layer) include typical methods such as a dip coating method, a push-up coating method, a wire bar coating method, a spray coating method, a blade coating method, a knife coating method, and a curtain coating method.

For example, the film thickness of the surface protective layer is preferably set in a range of 1 to 20 μm, and more preferably in a range of 2 to 10 μm.

—Image Forming Apparatus and Process Cartridge—

An image forming apparatus and a process cartridge are the same as in the first exemplary embodiment, and thus description thereof be omitted. In addition, with regard to a charging device, an exposure device, a development device, a transfer device, and an intermediate transfer body which relate to the image forming apparatus are the same as in the first exemplary embodiment, and thus description thereof will be omitted.

—Cleaning Device—

As a cleaning device 13 supported to the process cartridge, a cleaning blade type device including a cleaning blade 131 is used.

Note that, in addition to the cleaning blade type, a fur brush cleaning type, or a simultaneous development and cleaning type may be employed.

EXAMPLES

Hereinafter, examples according to the first exemplary embodiment will be described, but the invention is not limited to these examples. Note that, in the following description, "part" and "%" are based on a mass unless otherwise stated.

<Manufacturing of Fluorine-Containing Resin Particles>

(Manufacturing of Fluorine-Containing Resin Particles (1))

The fluorine-containing resin particles (1) are manufactured as follows.

An autoclave is charged with 3 liters of deionized water, 3.0 g of ammonium perfluorooctanoate, and 110 g of paraffin wax (manufactured by Nippon Oil Corporation) as an emulsion stabilizer, oxygen is removed by replacing the inside of the system with nitrogen three times and with tetrafluoroethylene (TFE) two times, an internal pressure is set to 1.0 MPa with the TFE, and an internal temperature is maintained at 70° C. while stirring the resultant mixture at 250 rpm. Next, as a chain transfer agent, 20 ml of an aqueous solution in which 150 cc of ethane and 300 mg of ammonium persulfate as a polymerization initiator are dissolved at atmospheric pressure is charged into the system to initiate a reaction. During the reaction, TFE is continuously supplied so that the temperature in the system is maintained at 70° C.

and the internal pressure of the autoclave is always maintained at 1.0±0.05 MPa. When the TFE consumed in the reaction reaches 1000 g after addition of the initiator, supply of the TFE and stirring are stopped, and the reaction is terminated. Then, particles are separated by centrifugation, 400 parts by mass of methanol is further collected, and the particles are washed with an agitator at 250 rpm for 10 minutes while performing irradiation with ultrasonic waves, and a supernatant is filtered. After repeating this operation three times, a filtrate is dried under reduced pressure at 60° C. for 17 hours.

Through the above-described processes, the fluorine-containing resin particles (1) are manufactured.

Example 1

(Manufacturing of Photoreceptor)

A photoreceptor is manufactured by using the obtained fluorine-containing resin particles.

100 parts of zinc oxide (average particle size: 70 nm, manufactured by Tayca Corporation, specific surface area value: 15 $m^2/g$) and 500 parts of tetrahydrofuran are stirred and mixed, and 1.4 parts of silane coupling agent (KBE503, manufactured by Shin-Etsu Chemical Co., Ltd.) is added to the resultant mixture, and stirring is performed for two hours. Then, toluene is distilled under reduced pressure and baking is carried out at 120° C. for three hours to obtain a zinc oxide subjected to a surface treatment with a silane coupling agent.

110 parts of zinc oxide subjected to the surface treatment and 500 parts of tetrahydrofurane are stirred and mixed, a solution obtained by dissolving 0.6 parts of alizarin in 50 parts of tetrahydrofurane is added to the resultant mixture, and the resultant mixture is stirred at 50° C. for five hours. Then, the zinc oxide to which the alizarin is applied is filtered under reduced pressure, and further dried under reduced pressure at 60° C. to obtain alizarin-applied zinc oxide.

60 parts of alizarin-applied zinc oxide, 13.5 parts of curing agent (blocked isocyanate Desmodur BL 3175, manufactured by Sumitomo Bayer Urethane Co., Ltd.), 15 parts of butyral resin (S-LEC BM-1, manufactured by SEKISUI CHEMICAL CO., LTD.), and 85 parts of methyl ethyl ketone are mixed to obtain a mixed solution. 38 parts of the mixed solution and 25 parts of methyl ethyl ketone are mixed and dispersed with a sand mill for two hours using 1 mmϕ glass beads to obtain a dispersion solution.

0.005 parts of dioctyl tin dilaurate as a catalyst, and 30 parts of silicone resin particles (Tospearl 145, manufactured by Momentive Performance Materials Inc.) are added to the obtained dispersion solution, thereby obtaining an undercoat layer application solution. The application solution is applied onto a cylindrical aluminum substrate by a dip coating method, and is dried and cured at 170° C. for 30 minutes to obtain an undercoat layer having a thickness of 24 μm.

Next, 1 part of hydroxygallium phthalocyanine in which a Bragg angle (20±0.2°) in an X-ray diffraction spectrum has a strong diffraction peak at 7.5°, 9.9°, 12.5°, 16.3°, 18.6°, 25.1°, and 28.3° was mixed with 1 part of polyvinyl butyral (S-REC BM-5, manufactured by SEKISUI CHEMICAL CO., LTD.) and 80 parts of n-butyl acetate, and the resultant mixture is subjected to a dispersion treatment with glass beads in a paint shaker for one hour, thereby preparing a charge generation layer application solution. The obtained application solution is applied onto a conductive base body provided with an undercoat layer by dip coating, and is dried by heating at 130° C. for 10 minutes to form a charge generation layer having a film thickness of 0.15 μm.

45 parts of benzidine compound expressed by the following Formula (CTM1) as a charge transportation material and 55 parts of polymer compound having a repeating unit expressed by the following Formula (PCZ1) as a binder resin (viscosity-average molecular weight: 40,000) are dissolved in 350 parts of toluene and 150 parts of tetrahydrofuran, and 8.0 parts of fluorine-containing resin particles (1) and 0.4 parts of fluorine-containing graft polymer (trade name: GF400, manufactured by TOAGOSEI CO., LTD.) are added to the resultant mixture, and the resultant mixture is treated five times with a high-pressure homogenizer, thereby preparing a charge transportation layer application solution.

The obtained application solution is applied onto the charge generation layer by a dip coating method, and is heated at 120° C. for 30 minutes while spraying air at a wind speed of 1.5 m/s, thereby forming a charge transportation layer having a film thickness of 31 μm.

(CTM1)

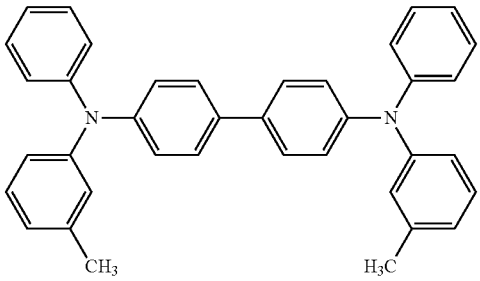

(PCZ1)

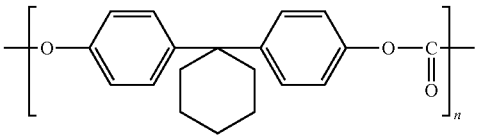

Through the above-described processes, a photoreceptor is manufactured.

(Manufacturing of Process Cartridge)

The manufactured photoreceptor is mounted to a process cartridge provided with a cleaning member in an image forming apparatus (DocuPrint CP500d, manufactured by Fuji Xerox Co., Ltd.), thereby obtaining a process cartridge. Note that, a total of five cartridges in which a contact pressure of the cleaning member with respect to the photoreceptor is set as in Table 2 are manufactured.

Examples 2 to 18 and Comparative Example 1 to 4

A photoreceptor and a process cartridge are manufactured in a similar manner as in Example 1 except that the kind, the added amount, and the occupancy area of the fluorine-containing resin particles, the added amount of the fluorine-containing graft polymer, heating conditions of the charge transportation layer application solution, and a contact pressure of the cleaning member with respect to the photoreceptor are changed as described in Table 2 and Table 3. Note that, only one process cartridge is manufactured in each example.

<Evaluation>

(Image Quality Evaluation)

The process cartridges obtained in each example are individually packed (packed for shipping), is set in a vibration tester (G-9223LS type, manufactured by Shinken Co., Ltd.), and all vibration conditions (i) to (iii) shown in the following Table 1 are applied to each of the process cartridges (* in Table 1 represents that a frequency is changed from 3 Hz to 100 Hz at a sweep rate of 0.3 Hz/sec and then from 100 Hz to 3 Hz at a sweep rate of 0.3 Hz/sec). The process cartridge is mounted in an image forming apparatus (DocuPrint CP500d, manufactured by Fuji Xerox Co., Ltd.), image formation was performed by outputting a halftone image having a density of 30% under an environment of 22° C. and 55% RH to A4 paper (P paper, manufactured by Fuji Xerox Co., Ltd.), and images formed on the first sheet and the fifteenth sheet are visually evaluated. Then, after being left as is for 24 hours, the image formed on the first sheet is visually evaluated. Evaluation criteria are as follows.

—Determination Criteria—

A: Streak does not occur.

B: Presence of a streak is slightly visible when gazing.

C: Presence of a streak-shaped image is slightly confirmed in a halftone image, but has no problem in practical use.

D: Presence of a streak-shaped image is confirmed in a halftone image, but is not detected in a character image.

E: Presence of a streak-shaped image is clearly identified in a halftone image, and presence of a streak is slightly confirmed also in a character image.

F: Presence of a streak is clearly confirmed in a halftone image and a character image.

(Residual Potential Evaluation)

In a state in which the photoreceptor obtained in each example is rotated at 100 rpm, the photoreceptor is charged to −700 V with a scorotron charger, and is discharged by irradiating the photoreceptor with light of 2.0 mJ/m$^2$ by using a semiconductor laser having a wavelength of 780 nm after 0.05 seconds from the charging. Next, charges are removed by irradiating the photoreceptor with red LED light of 20 mJ/m$^2$ after 0.1 seconds from the discharging. In addition, a surface potential V of the photoreceptor after 100 msec from the charge removal is measured, and this potential is set as a value of the residual potential.

The residual potential is devalued in accordance with the following criteria.

A: −50 V or higher

B: lower than −50 V and higher than −100 V

C: lower than −100 V

Hereinafter, description in Table 2 and Table 3 will be described.

"Heating conditions" represent heating conditions of a coated-film of the charge transportation layer application solution at the time of forming the charge transportation layer.

"Fluorine atom concentration ratio" represents a magnification of a fluorine atom concentration measured on a surface of the charge transportation layer with respect to a fluorine atom concentration measured at a depth of 1 μm from the surface of the charge transportation layer.

"Charge transportation material concentration ratio" represents a magnification of a concentration of the charge transportation material which is measured on the surface of the charge transportation layer with respect to a concentration of the charge transportation material which is measured at the center of the thickness of the charge transportation layer.

TABLE 1

| Conditions | Vibration elevation | Frequency | | Sweep rate | | Acceleration | | Vibration time |
|---|---|---|---|---|---|---|---|---|
| (i) | Vertical | 3 Hz → 100 Hz → 3 Hz* | | 0.3 Hz/sec | | 6.9 m/s$^2$ (constant) | | 10 min |
| (ii) | Vertical | Oscillation frequency (fixed) | | — | | 6.9 m/s$^2$ (constant) | | 20 min |
| (iii) | Vertical | Mode A | | Mode B | | Mode C | | |
| | | Hz | G$^2$/Hz | Hz | G$^2$/Hz | Hz | G$^2$/Hz | Each mode: 20 min |
| | | 1 | 0.00005 | 1 | 0.00001 | 2 | 0.002 | Total: 1 Hr |
| | | 4 | 0.01 | 2 | 0.001 | 12 | 0.01 | |
| | | 16 | 0.01 | 50 | 0.001 | 100 | 0.01 | |
| | | 40 | 0.001 | 90 | 0.0004 | 300 | 0.00001 | |
| | | 80 | 0.001 | 200 | 0.00001 | | | |
| | | 200 | 0.00001 | | | | | |
| | | 0.52 Grms | | 0.29 Grms | | 1.05 Grms | | |

TABLE 2

| | Photoreceptor | | | | | | | | | | Evaluation | | | |
|---|---|---|---|---|---|---|---|---|---|---|---|---|---|---|
| | Flourine-containing resin particles | | | Flourine-containing graft polymer | Heating conditions | | | Flourine atom | Charge | Process | Image quality evaluation | | | |
| | Kind | Added Amount parts | Occupancy area (%) | Added amount (parts) | Wind speed (m/s) | Temperature (° C.) | Time (min) | concentration ratio | material concentration ratio | cartridge Contact pressure (g/mm) | First | Fifteenth | After 24 hours | Residual potential |
| Example 1 | (1) | 8.0 | 0.33 | 0.40 | 1.5 | 120 | 3.0 | 3.0 | 0.40 | 5.0 | C | C | B | A |
| | | | | | | | | | | 4.0 | B | B | A | A |
| | | | | | | | | | | 2.5 | B | A | A | A |
| | | | | | | | | | | 1.0 | B | B | A | A |
| | | | | | | | | | | 0.8 | C | B | B | A |

TABLE 2-continued

| | Photoreceptor | | | | | | | | | | Evaluation | | | |
|---|---|---|---|---|---|---|---|---|---|---|---|---|---|---|
| | Flourine-containing resin particles | | | Flourine-containing graft polymer | Heating conditions | | | Flourine atom concentration ratio | Charge temperature material concentration ratio | Process cartridge Contact pressure (g/mm) | Image quality evaluation | | | |
| | Kind | Added Amount parts | Occupancy area (%) | Added amount (parts) | Wind speed (m/s) | Temperature (° C.) | Time (min) | | | | First | Fifteenth | After 24 hours | Residual potential |
| Example 2 | (1) | 8.0 | 0.50 | 0.20 | 1.5 | 130 | 25 | 1.5 | 0.55 | 2.5 | C | B | B | A |
| Example 3 | (1) | 8.0 | 0.33 | 0.80 | 1.5 | 120 | 30 | 5.0 | 0.41 | 2.5 | B | B | B | B |
| Example 4 | (1) | 8.2 | 0.34 | 0.40 | 1.5 | 120 | 30 | 3.4 | 0.40 | 2.5 | C | B | A | A |
| Example 5 | (1) | 16.0 | 1.10 | 0.40 | 1.5 | 120 | 30 | 2.4 | 0.42 | 2.5 | B | B | B | B |
| Example 6 | (1) | 14.5 | 1.00 | 0.40 | 1.5 | 120 | 30 | 2.8 | 0.42 | 2.5 | B | B | B | B |
| Example 7 | (1) | 8.7 | 0.36 | 0.40 | 1.5 | 120 | 30 | 3.0 | 0.41 | 2.5 | B | B | A | A |
| Example 8 | (1) | 8.5 | 0.35 | 0.40 | 1.5 | 120 | 30 | 2.9 | 0.42 | 2.5 | C | B | A | A |
| Example 9 | (1) | 13.8 | 0.95 | 0.40 | 1.5 | 120 | 30 | 2.5 | 0.40 | 2.5 | B | B | A | A |
| Example 10 | (1) | 14.0 | 0.96 | 0.40 | 1.5 | 120 | 30 | 3.2 | 0.41 | 2.5 | B | B | B | B |
| Example 11 | (1) | 8.0 | 0.33 | 0.40 | 1.5 | 122 | 30 | 3.4 | 0.42 | 2.5 | B | B | B | A |
| Example 12 | (1) | 8.0 | 0.34 | 0.40 | 1.5 | 138 | 30 | 3.1 | 0.58 | 2.5 | C | C | C | B |
| Example 13 | (1) | 8.0 | 0.33 | 0.40 | 1.5 | 132 | 30 | 3.5 | 0.52 | 2.5 | B | B | B | A |
| Example 14 | (1) | 8.0 | 0.34 | 0.40 | 1.5 | 140 | 30 | 2.8 | 0.60 | 2.5 | C | C | C | B |
| Example 15 | (1) | 8.0 | 0.35 | 0.40 | 0.5 | 140 | 25 | 2.9 | 0.45 | 2.5 | A | A | A | A |
| Example 16 | (1) | 8.0 | 0.33 | 0.40 | 0.7 | 140 | 25 | 3.0 | 0.50 | 2.5 | B | B | B | B |
| Example 17 | (1) | 8.0 | 0.35 | 0.40 | 0.8 | 140 | 25 | 3.7 | 0.47 | 2.5 | A | A | A | A |
| Example 18 | (1) | 8.0 | 0.33 | 0.40 | 1.2 | 140 | 25 | 3.2 | 0.56 | 2.5 | B | B | B | B |

TABLE 3

| | Photoreceptor | | | | | | | | | | Evaluation | | | |
|---|---|---|---|---|---|---|---|---|---|---|---|---|---|---|
| | Flourine-containing resin particles | | | Flourine-containing graft polymer | Heating Conidition | | | Fluorine atom concentration ratio | Charge transportation material concentration ratio | Process cartridge Contact pressure (g/mm) | Image quality evaluation | | | |
| | Kind | Added amount (parts) | Occupancy area (%) | Added amount parts | Wind speed (m/s) | Temperature (° C.) | Time (min) | | | | First | Fifteenth | After 24 hours | Residual potential |
| Comparative Example 1 | (1) | 8.0 | 0.20 | 0.10 | 0.1 | 90 | 60 | 1.1 | 0.95 | 2.5 | E | D | C | A |
| Comparative Example 2 | (1) | 8.0 | 1.50 | 1.40 | 2.0 | 150 | 20 | 7.0 | 0.30 | 2.5 | C | B | B | C |
| Comparative Example 3 | (1) | 8.0 | 0.30 | 0.17 | 1.0 | 130 | 25 | 1.4 | 0.40 | 2.5 | E | C | C | A |
| Comparative Example 4 | — | 8.0 | 0.00 | 0.00 | 1.5 | 120 | 30 | 0.0 | 0.35 | 2.5 | F | E | D | A |

From the results, in the photoreceptor of this exemplary embodiment, it is shown that it is possible to suppress occurrence of the streak-shaped image defects and the residual potential which are caused by rubbing between the photoreceptor and a member that comes into contact with the photoreceptor due to vibration.

Hereinafter, the second exemplary embodiment will be described with reference to examples, but this exemplary embodiment is not limited to the examples. Note that, in the following description, "part" and "%" are based on a mass unless otherwise stated.

Manufacturing of Electrophotographic Photoreceptor

Example 19

(Formation of Undercoat Layer)

100 parts by mass of zinc oxide particles (trade name: MZ 300, manufactured by Tayca Corporation, volume-average primary particle size: 35 nm), 10 parts by mass of 10 mass % toluene solution of N-2-(aminoethyl)-3-aminopropyltriethoxysilane as a silane coupling agent, and 200 parts by mass of toluene are mixed and stirred, and are refluxed for two hours. Then, toluene is distilled under reduced pressure at 10 mmHg and is baked at 135° C. for 2 hours to perform a surface treatment of the zinc oxide with the silane coupling agent.

33 parts by mass of surface-treated zinc oxide particles, 6 parts by mass of blocked isocyanate (trade name: Desmodur BL 3175, manufactured by Sumitomo Bayer Urethane Co., Ltd.), 1 part by mass of compound expressed by the following Structural Formula (AK-1), and 25 parts by mass of methyl ethyl ketone are mixed for 30 minutes. Then, 5 parts by mass of butyral resin (trade name: S-LEC BM-1, manufactured by SEKISUI CHEMICAL CO., LTD.), 3 parts by mass of silicone ball (trade name: Tospearl 120, manufactured by Momentive Performance Materials Co., Ltd.), 0.01 parts by mass of Toray Dow Corning Silicone Oil (trade name: SH29PA, manufactured by Dow Corning Co.) as a leveling agent are added, and the mixture is dispersed for 1.8 hours in a sand mill (that is, the dispersion time was set to 1.8 hours), thereby obtaining an undercoat layer forming application solution.

(AK-1)

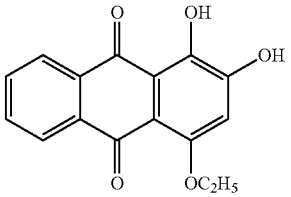

The obtained undercoat layer forming application solution is applied onto an aluminum base body (conductive base body) having a diameter of 47 mm, a length of 357 mm, and a thickness of 1 mm by a dip coating method, and is dried and cured at 180° C. for 30 minutes, thereby obtaining an undercoat layer having a film thickness of 25 μm.

(Formation of Charge Generation Layer)

A mixture composed of a hydroxygallium phthalocyanine pigment "V-type hydroxygallium phthalocyanine pigment in which a Bragg angle (2θ±0.2°) of an X-ray diffraction spectrum using Cukα characteristic rays has a diffraction peak at least a position of 7.3°, 16.0°, 24.9°, and 28.0° " (a maximum peak wavelength in a spectral absorption spectrum in a wavelength region of 600 to 900 nm is 820 nm, an average particle size is 0.12 μm, a maximum particle size is 0.2 μm, and a specific surface area value is 60 $m^2/g$) as a charge generation material, a vinyl chloride-vinyl acetate copolymer resin (trade name: VMCH, manufactured by NUC Co., Ltd.) as a binder resin, and an n-butyl acetate is put into a glass bottle with capacity of 100 mL at a filling rate of 50% in combination with glass beads of 1.0 mmϕ. The mixture is subjected to a dispersion treatment for 2.5 hours by using a paint shaker to obtain a charge generation layer application solution. With respect to the mixture of the hydroxygallium phthalocyanine pigment and the vinyl chloride-vinyl acetate copolymer resin, the content ratio of the hydroxygallium phthalocyanine pigment is set to 55.0% by volume, and the solid content of the dispersion solution is set to 6.0% by mass. The content ratio is calculated in a state in which the specific gravity of the hydroxygallium phthalocyanine pigment is set to 1.606 $g/cm^3$ and the specific gravity of the vinyl chloride-vinyl acetate copolymer resin is set to 1.35 $g/cm^3$.

The obtained charge generation layer forming application solution is applied onto the undercoat layer by dip coating, and is dried at 100° C. for five minutes, thereby forming a charge generation layer having a film thickness of 0.20 μm.

(Formation of Charge Transportation Layer)

8.0 parts by mass of exemplified compound (CT1-1) that is a hole transportation material expressed by General Formula (1) and 32.0 parts by mass of benzidine-based charge transportation material (CT2-1) as a charge transportation material, 60.0 parts by mass of BP polycarbonate resin (pm:pn=25:75, viscosity-average molecular weight: 50,000) expressed by General Formula (PC-1) as a binding resin, 8 parts by mass of polytetrafluoroethylene (PTFE) as fluorine-containing resin particles, 0.2 parts by mass of "GF400 (manufactured by TOAGOSEI CO., LTD., a surfactant containing at least a methacrylate having a fluorinated alkyl group as a polymerization component)" as a fluorine-containing dispersant, and 3.2 parts by mass of a hindered phenolic antioxidant (molecular weight: 775) as an antioxidant (8.0 parts by mass with respect to 100% by mass of the total amount of all charge transportation materials) are added to 340.0 parts by mass of tetrahydrofuran to be dissolved, and the resultant mixture is treated 10 times with a high-pressure homogenizer, thereby obtaining a charge transportation layer forming application solution. The obtained charge transportation layer forming application solution is applied onto the charge generation layer by dip coating.

At the time of the dip coating, a temperature of the application solution is set to 31° C., a rising speed of the application solution is set to 800 mm/min, a rising speed of a member to be coated (base body on which the charge generation layer is formed) is set to 300 mm/min, a relative speed difference between the application solution and the member to be coated is set to 500 mm/min, and drying is performed at 150° C. for 40 minutes to form a charge transportation layer having a film thickness of 40 μm. The resultant body is set as an electrophotographic photoreceptor.

Note that, the number of carboxy groups in the fluorine-containing resin particles which is measured by the above-described method, and the amount of the triethylamine (boiling point: 89° C.) that is a basic compound are shown in Table 4.

Examples 20 to 29 and Comparative Example 7

An electrophotographic photoreceptor of each example is manufactured in a similar manner as in Example 19 except that the kind and the amount of the fluorine-containing resin particles, the state (N1 to N3, N2/N1, S1, S2, S2/S1, N3/N1, D1, D2, and D2/D1) of the outermost surface layer, the relative speed difference between the charge transportation layer forming application solution and the member to be coated (base body on which the charge generation layer is formed), the kind and the amount of the charge transportation material, and the like in Example 19 are changed to specifications shown in Table 4 and Table 5. Note that, in the case of using plural kinds of charge transportation materials, the amount of the charge transportation material as shown in Table 4 represents a total amount of respective charge transportation materials.

Comparative Examples 5 and 6

An electrophotographic photoreceptor of each example is manufactured in a similar manner as in Example 19 except that an application solution temperature is set to 15° C., the kind and the amount of the fluorine-containing resin particles, the state (N1 to N3, N2/N1, S1, S2, S2/S1, N3/N1, D1, D2, and D2/D1) of the outermost surface layer, the number of times of treatment in the high-pressure homogenizer, the kind and the amount of the charge transportation material, and the like in formation of the charge transportation layer in Example 19 are changed to specifications shown in Table 4 and Table 5. Note that, in the case of using plural kinds of charge transportation materials, the amount of the charge transportation material as shown in Table 4 represents a total amount of respective charge transportation materials.

DocuCentre-V C7776 manufactured by Fuji Xerox Co., Ltd. In addition, a running test of outputting 100,000 sheets (100 kPV) of half-tone images (that is, an image density: 50%) under an environment of a temperature of 20° C. and humidity of 40%, then an abrasion amount on the outermost surface of the electrophotographic photoreceptor is measured by an eddy-current film thickness meter from a difference between a film thickness measured before running and a film thickness measured after running. Results are shown in Table 5.

TABLE 4

| | Fluorate-containing mean particles | | | | Change transportation material | | Speed difference between |
|---|---|---|---|---|---|---|---|
| Electrophotographic photoreceptor | Kind | Number of carbonyte groups [pieces] | Amount of basic compound [ppm] | Amount [part] | Kind | Amount [part] | application solution and member to be seated (max/min) |
| 1 | PTFE | 7 | 0 | 8 | CT1-1/CT2-1 | 40 | 500 |
| 2 | PTFE | 7 | 0 | 8 | CT1-1/CT2-1 | 40 | 300 |
| 3 | PTFE | 7 | 0 | 8 | CT2-1 | 40 | 200 |
| 4 | PTFE | 7 | 0 | 9 | CT1-1/CT2-1 | 40 | 400 |
| 5 | PTFE | 7 | 0 | 8 | CT1-1/CT2-1 | 40 | 600 |
| 6 | PTFE | 7 | 0 | 6 | CT1-1/CT2-1 | 40 | 100 |
| 7 | PTFE | 7 | 0 | 8 | CT1-1/CT2-1 | 40 | 800 |
| 8 | PTFE | 75 | 2 | 8 | CT1-1/CT2-1 | 40 | 500 |
| 9 | PTFE | 15 | 5 | 8 | CT1-1/CT2-1 | 40 | 500 |
| c1 | PTFE | 7 | 0 | 8 | CT1-1/CT2-1 | 40 | 300 |
| c2 | PTFE | 7 | 0 | 8 | CT1-1/CT2-1 | 40 | 500 |
| c3 | PTFE | 7 | 0 | 8 | CT1-1/CT2-1 | 40 | 0 |

—Evaluation of Sensitivity—

Evaluation of sensitivity in the electrophotographic photoreceptor in each example is performed as a half-exposure amount when the electrophotographic photoreceptor is charged to +800 V. Specifically, first, the electrophotographic photoreceptor of each example is charged to +800 V by using an electrostatic copying paper tester (electrostatic analyzer EPA-8100, manufactured by Kawaguchi-denki) in an environment of temperature of 20° C./relative humidity of 40%. Then, light of the tungsten lamp is converted into monochromatic light of 800 nm by using a monochromator, and irradiation with the monochromatic light is performed by adjusting the light amount to be 1 μW/cm$^2$ on the surface of the electrophotographic photoreceptor. Then, a half-exposure amount (μJ/cm$^2$) at which the surface potential Vo (V) of the electrophotographic photoreceptor immediately after charging becomes ½ due to light irradiation is measured. Values of the obtained half-exposure amount are classified according to the following criteria. The results are shown in Table 5. If sensitivity decreases, image quality decreases, and as a result, image defects occur.

G1: Half-exposure amount is 0.10 μJ/cm$^2$.

G2: Half-exposure amount is larger than 0.10 μJ/cm$^2$ and equal to or less than 0.13 μJ/cm$^2$.

G3: Half-exposure amount is larger than 0.13 μJ/cm$^2$ and equal to or less than 0.15 μJ/cm$^2$.

G4: Half-exposure amount is larger than 0.15 μJ/cm$^2$ and equal to or less than 0.18 μJ/cm$^2$.

G5: Half-exposure amount is larger than 0.18 μJ/cm$^2$.

—Evaluation of Abrasion Resistance—

The electrophotographic photoreceptor of each example is mounted to a black process cartridge in a color copier —Evaluation of Number of Dot-Shaped Image Defects—

Evaluation on suppression of occurrence of a leak current is performed by using a phenomenon in which when carbon fiber penetrates respective layers and reach the conductive base body, a current flows, and dot-shaped image defects occur.

The electrophotographic photoreceptor of each example is mounted in black of DocuCentre-V C7776. In addition, a developer in which carbon fiber (MLD-30, manufactured by TORAY INDUSTRIES, INC.) is mixed in an amount of 10 mg (0.1% by mass) with respect to the amount of developer was used. 10 sheets of black images with an image density of 15% are continuously output on A4 white paper. Results of visually counting the number of dot-shaped image defects on the obtained tenth paper are shown in Table 5.

—Evaluation of Charging Properties—

Charging properties of the electrophotographic photoreceptor of each example are evaluated as follows.

After setting a surface potential after charging is to −700 V by an image forming apparatus for evaluation, 70,000 sheets of full-size half-tone images with an image density of 30% are continuously output on A4 paper under a high-temperature and high-humidity environment (under an RH environment of a temperature of 28° C. and humidity of 85%). In addition, a surface potential is measured by a surface potential meter, and evaluation is performed in accordance with the following criteria.

G1: Surface potential is equal to or greater than −700 V and less than −690 V

G2: Surface potential is equal to or greater than −690 V and less than −675 V

G3: Surface potential is equal to or greater than −675 V and less than −660 V (level with no problem in practical use)

G4: Surface potential is equal to or greater than −660 V and less than −640 V

G5: Surface potential is equal to or greater than −640 V

TABLE 5

| Classification | Electrophotographic photoreceptor | State of material surface layer | | | | | | | | | Evaluation | | | |
|---|---|---|---|---|---|---|---|---|---|---|---|---|---|---|
| | | N1 [Number %] | N2 [Number %] | N3 [Number %] | N2/N1 | N3/N1 | S2/S1 | D1 [μm] | D2 [μm] | D2/D1 | Sensitivity | Abrasion amount [μm 100 kPV] | Number of dot-shaped image defects [pieces] | Charging properties |
| Example 19 | 1 | 8.0 | 5.0 | 4.0 | 0.63 | 0.5 | 1.04 | 0.5 | 9 | 18.0 | G1 | 6.0 | 12 | G1 |
| Example 20 | 2 | 8.5 | 6.0 | 4.0 | 0.71 | 0.47 | 0.98 | 0.4 | 5 | 12.5 | G2 | 6.0 | 15 | G2 |
| Example 21 | 3 | 10 | 8 | 7.5 | 0.80 | 0.75 | 0.96 | 0.3 | 3 | 10.0 | G2 | 6.5 | 19 | G2 |
| Example 22 | 4 | 5 | 4 | 3 | 0.80 | 0.50 | 1.03 | 2 | 3.5 | 1.8 | G2 | 10 | 13 | G1 |
| Example 23 | 5 | 7.5 | 3.5 | 2.0 | 0.47 | 0.27 | 1.01 | 0.3 | 10 | 33.3 | G3 | 5.5 | 9 | G1 |
| Example 24 | 6 | 55 | 45 | 35 | 0.82 | 0.64 | 0.93 | 0.15 | 0.5 | 3.3 | G3 | 6.00 | 17 | G1 |
| Example 25 | 7 | 4.0 | 2.5 | 2.0 | 0.63 | 0.50 | 1.07 | 3 | 12 | 4.0 | G1 | 7.0 | 10 | G2 |
| Example 26 | 8 | 30 | 23 | 18 | 0.77 | 0.60 | 1.02 | 0.2 | 0.9 | 4.5 | G1 | 6.5 | 18 | G4 |
| Example 27 | 9 | 25 | 18 | 13 | 0.72 | 0.52 | 0.96 | 0.25 | 1 | 4.0 | G3 | 7.0 | 16 | G3 |
| Comparative Example 5 | c1 | 5 | 8 | 5 | 1.60 | 1.00 | 1.08 | 9 | 0.5 | 0.1 | G5 | 12 | 51 | G4 |
| Comparative Example 6 | c2 | 8.0 | 5.0 | 4.0 | 0.63 | 0.50 | 1.15 | 0.5 | 9 | 18.0 | G4 | 14 | 14 | G5 |
| Comparative Example 7 | c3 | 60 | 58 | 50 | 0.97 | 0.83 | 1.06 | 0.2 | 0.25 | 1.3 | G5 | 11 | 28 | G3 |

As shown in Table 5, it could be understood that electrophotographic photoreceptors of the examples are more excellent in the sensitivity and the abrasion resistance in comparison to electrophotographic photoreceptors of comparative examples. In addition, it could be understood that in the electrophotographic photoreceptors of examples, occurrence of a leak current occurring in a case where needle-shaped foreign matters such as carbon fiber are mixed in the developer is also further suppressed in comparison to the electrophotographic photoreceptors of comparative examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

REFERENCE SIGNS LIST

1, 101 Undercoat layer
2, 102 Charge generation layer
3, 103 Charge transportation layer
4, 104 Conductive base body
7A, 7, 107A, 107B Electrophotographic photoreceptor
8 Charging device
9 Exposure device
11 Development device
13 Cleaning device
14 Lubricant
40 Transfer device
50 Intermediate transfer body
100 Image forming apparatus
120 Image forming apparatus
131 Cleaning blade
132 Fiber-shaped member (roll shape)
133 Fiber-shaped member (flat brush shape)
300 Process cartridge
105 Photosensitive layer
106 Surface protective layer

What is claimed is:

1. An electrophotographic photoreceptor comprising:
a conductive base body; and
a photosensitive layer,
wherein an outermost surface layer of the electrophotographic photoreceptor contains fluorine-containing resin particles, and
wherein a fluorine atom concentration at a surface of the outermost surface layer is 1.5 to 5.0 times higher than a fluorine atom concentration at a depth of 1 μm from the surface of the outermost surface layer, or
wherein a ratio (N2/N1) between a number density (N1) of aggregates of the fluorine-containing resin particles in a first region from a surface of the outermost surface layer to a half of the outermost surface layer in a thickness direction of the outermost surface layer and a number density (N2) of aggregates of the fluorine-containing resin particles in a second region from the half of the outermost surface layer to a bottom face of the outermost surface layer is less than 0.95, and
a ratio (S2/S1) between an area ratio (S1) of the fluorine-containing resin particles in the first region, and an area ratio (S2) of the fluorine-containing resin particles in the second region is within a range of 1±0.1.

2. The electrophotographic photoreceptor according to claim 1,
wherein an occupancy area of the fluorine-containing resin particles at the surface of the outermost surface layer is 0.33% to 1.1%.

3. The electrophotographic photoreceptor according to claim 2,
wherein the occupancy area of the fluorine-containing resin particles at the surface of the outermost surface layer is 0.36% to 0.95%.

4. The electrophotographic photoreceptor according to claim 3, wherein the photosensitive layer includes a charge generation layer and a charge transportation layer, the outermost surface layer is the charge transportation layer, and a concentration of a charge transportation material at a surface of the charge transportation layer is 0.4 to 0.6 times higher than a concentration of the charge transportation material at a center of the charge transportation layer in a thickness direction of the charge transportation layer.

5. The electrophotographic photoreceptor according to claim 2, wherein the photosensitive layer includes a charge generation layer and a charge transportation layer, the outermost surface layer is the charge transportation layer, and a concentration of a charge transportation material at a surface of the charge transportation layer is 0.4 to 0.6 times higher than a concentration of the charge transportation material at a center of the charge transportation layer in a thickness direction of the charge transportation layer.

6. The electrophotographic photoreceptor according to claim 5, wherein the concentration of the charge transportation material at the surface of the charge transportation layer is 0.45 to 0.56 times higher than the concentration of the charge transportation material at the center of the charge transportation layer in the thickness direction of the charge transportation layer.

7. The electrophotographic photoreceptor according to claim 1, wherein the photosensitive layer includes a charge generation layer and a charge transportation layer, the outermost surface layer is the charge transportation layer, and a concentration of a charge transportation material at a surface of the charge transportation layer is 0.4 to 0.6 times higher than a concentration of the charge transportation material at a center of the charge transportation layer in a thickness direction of the charge transportation layer.

8. The electrophotographic photoreceptor according to claim 7, wherein the concentration of the charge transportation material at the surface of the charge transportation layer is 0.45 to 0.56 times higher than the concentration of the charge transportation material at the center of the charge transportation layer in the thickness direction of the charge transportation layer.

9. The electrophotographic photoreceptor according to claim 1, wherein the ratio (N2/N1) is 0.1 to 0.8.

10. The electrophotographic photoreceptor according to claim 1, wherein a ratio (N3/N1) between the number density (N1) of the aggregates of the fluorine-containing resin particles in the first region from the surface of the outermost surface layer to the half of the outermost surface layer and a number density (N3) of aggregates of the fluorine-containing resin particles in a third region from 9/10 of the outermost surface layer in the thickness direction from the surface of the outermost surface layer, to the bottom face of the outermost surface layer is 0.9 or less.

11. The electrophotographic photoreceptor according to claim 1, wherein the ratio (N3/N1) is 0.7 or less.

12. The electrophotographic photoreceptor according to claim 1, wherein a ratio (D2/D1) between an average diameter (D1) of the aggregates of the fluorine-containing resin particles in the first region, and an average diameter (D2) of the aggregates of the fluorine-containing resin particles in the second region is 2 or greater.

13. The electrophotographic photoreceptor according to claim 12, wherein the ratio (D2/D1) is 3 to 30.

14. The electrophotographic photoreceptor according to claim 1, wherein the number density (N1) of the aggregates of the fluorine-containing resin particles in the first region is 5 to 50 pieces/100 $\mu m^2$.

15. The electrophotographic photoreceptor according to claim 1, wherein a number of carboxylic groups in the fluorine-containing resin particles is 0 to 30 per $10^6$ carbon atoms of the fluorine-containing resin particles, and an amount of a basic compound in the fluorine-containing resin particles is 0 to 3 ppm.

16. The electrophotographic photoreceptor according to claim 15, wherein the number of the carboxylic groups in the fluorine-containing resin particles is 0 to 20 per $10^6$ carbon atoms of the fluorine-containing resin particles, and the amount of the basic compound in the fluorine-containing resin particles is 0 to 3 ppm.

17. A process cartridge comprising:

the electrophotographic photoreceptor according to claim 1, wherein the process cartridge is configured to be attached to and detached from an image forming apparatus.

18. The process cartridge according to claim 17, further comprising:

a cleaning member configured to come into contact with the electrophotographic photoreceptor to clean the electrophotographic photoreceptor, wherein a contact pressure of the cleaning member against the electrophotographic photoreceptor is 1.0 to 4.0 g/mm.

19. An image forming apparatus comprising:

the electrophotographic photoreceptor according to claim 1;

a charging unit that is configured to charge a surface of the electrophotographic photoreceptor;

an electrostatic latent image forming unit that is configured to form an electrostatic latent image on the surface of the electrophotographic photoreceptor charged by the charging unit;

a development unit that is configured to develop the electrostatic latent image formed on the surface of the electrophotographic photoreceptor with a developer containing toner to form a toner image; and a transfer unit that is configured to transfer the toner image to a surface of a recording medium.

20. The image forming apparatus according to claim 19, further comprising:

a cleaning unit that is configured to cause a cleaning member to be in contact with the surface of the electrophotographic photoreceptor to clean the surface, wherein a contact pressure of the cleaning member against the electrophotographic photoreceptor is 1.0 to 4.0 g/mm.

* * * * *